US008042505B2

(12) United States Patent
Eisenbeis

(10) Patent No.: US 8,042,505 B2
(45) Date of Patent: Oct. 25, 2011

(54) INTERNAL COMBUSTION ENGINE COMPRISING A VARIABLE VALVE DRIVE

(76) Inventor: Uwe Eisenbeis, Munich (DE)

( * ) Notice: Subject to any disclaimer, the term of this patent is extended or adjusted under 35 U.S.C. 154(b) by 765 days.

(21) Appl. No.: 11/911,719

(22) PCT Filed: Apr. 18, 2006

(86) PCT No.: PCT/EP2006/003525
§ 371 (c)(1),
(2), (4) Date: Jun. 18, 2008

(87) PCT Pub. No.: WO2006/111350
PCT Pub. Date: Oct. 26, 2006

(65) Prior Publication Data

US 2008/0245325 A1 Oct. 9, 2008

(30) Foreign Application Priority Data

Apr. 17, 2005 (EP) ..... 05008327
Nov. 30, 2005 (DE) ..... 10 2005 057 127

(51) Int. Cl.
*F01L 1/26* (2006.01)

(52) U.S. Cl. ..... 123/90.22; 123/90.23; 123/90.39; 123/90.65

(58) Field of Classification Search ..... 123/90.2, 123/90.24, 90.22, 90.23, 90.39, 90.65
See application file for complete search history.

(56) References Cited

U.S. PATENT DOCUMENTS

| | | | |
|---|---|---|---|
| 6,684,832 | B1 | 2/2004 | Codina et al. |
| 2004/0103865 | A1 | 6/2004 | Duesmann |

FOREIGN PATENT DOCUMENTS

| | | | |
|---|---|---|---|
| DE | 2335634 | A1 | 1/1975 |
| FR | 1284700 | A | 2/1962 |
| FR | 2849465 | A | 7/2004 |
| JP | 5-179966 | A | 7/1993 |
| JP | 2001055915 | A | 2/2001 |
| JP | 2001-164911 | A | 6/2001 |

OTHER PUBLICATIONS

International Search Report mailed Aug. 8, 2006 (PCT/EP2006/003525).
Translation of International Preliminary Report on Patentability issued Oct. 23, 2007 (PCT/EP2006/003525).
Office Action dtd Jan. 18, 2011 for Japanese Application No. 2008-506991.

*Primary Examiner* — Ching Chang
(74) *Attorney, Agent, or Firm* — Patterson & Sheridan, L.L.P.

(57) ABSTRACT

The invention relates to an internal combustion engine comprising a valve drive which is arranged in the region of the cylinder head and is used to actuate a valve. Said internal combustion engine comprises a first drive means that can be rotated about a first rotational axis, a connecting rod that is connected to the first drive means in an articulated manner by means of a first connecting rod articulation, and a guiding element which is used to guide the connecting rod, can be pivoted about a guiding axis, and is connected to a second articulation of the connecting rod in an articulated manner. The position of the first rotational axis can be modified in relation to the cylinder head.

22 Claims, 17 Drawing Sheets

Figur 1
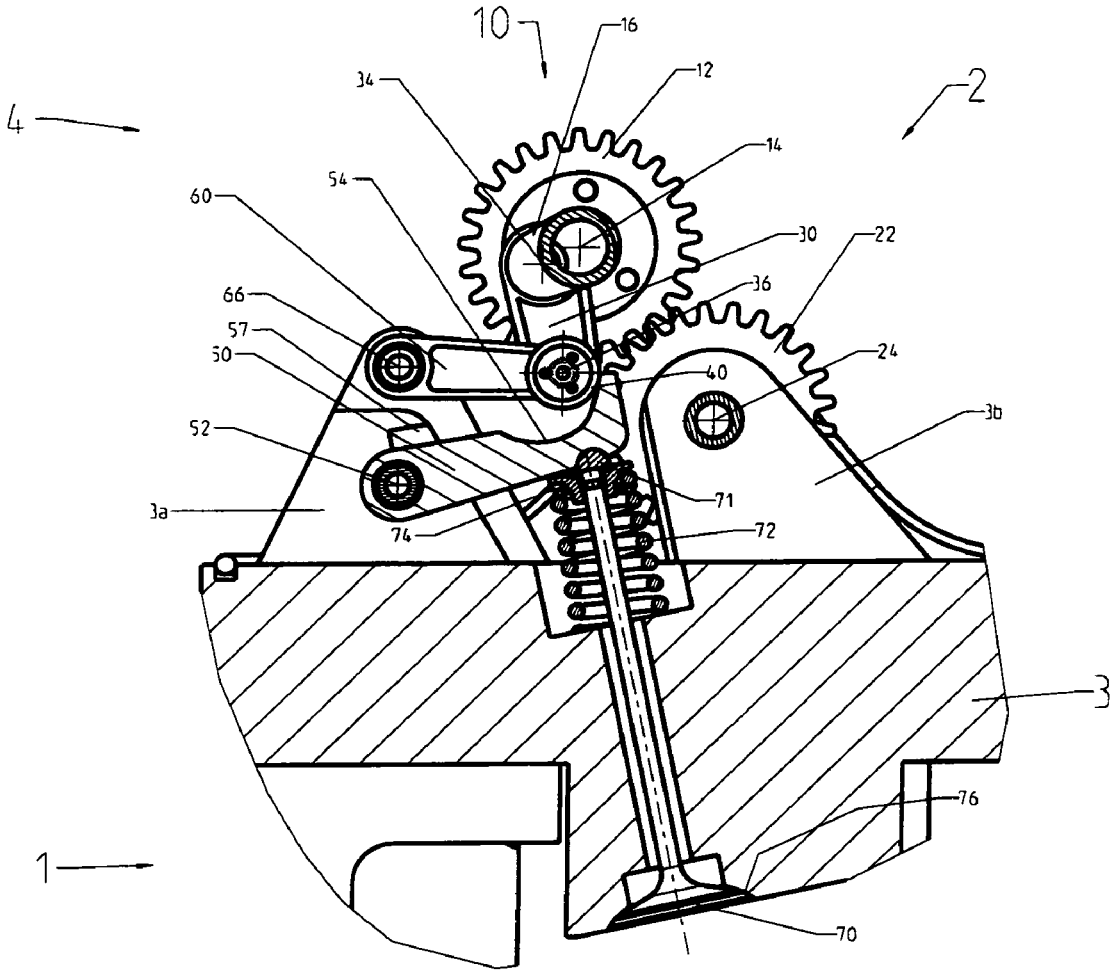

Figur 3
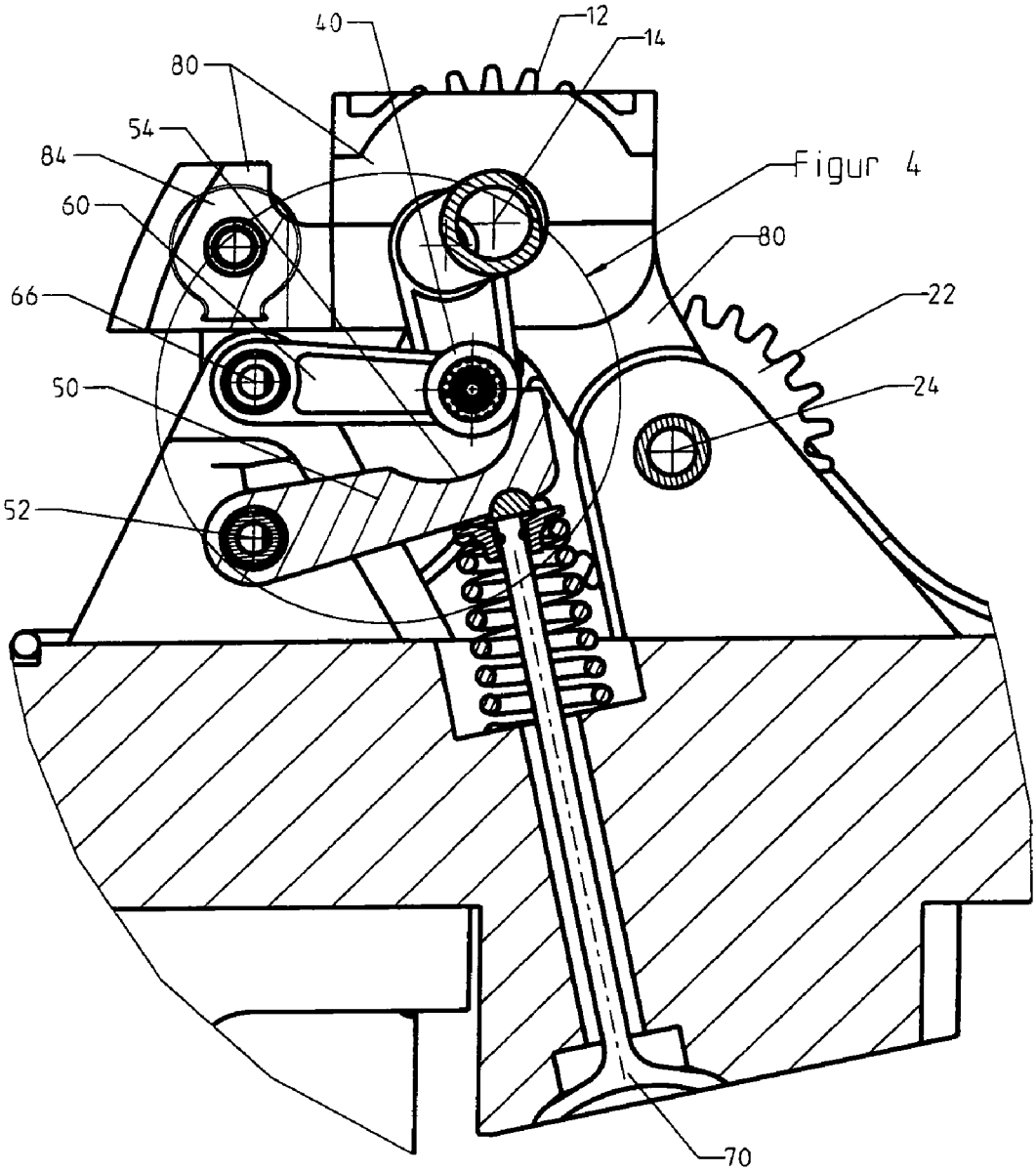

Figur 4
2:1
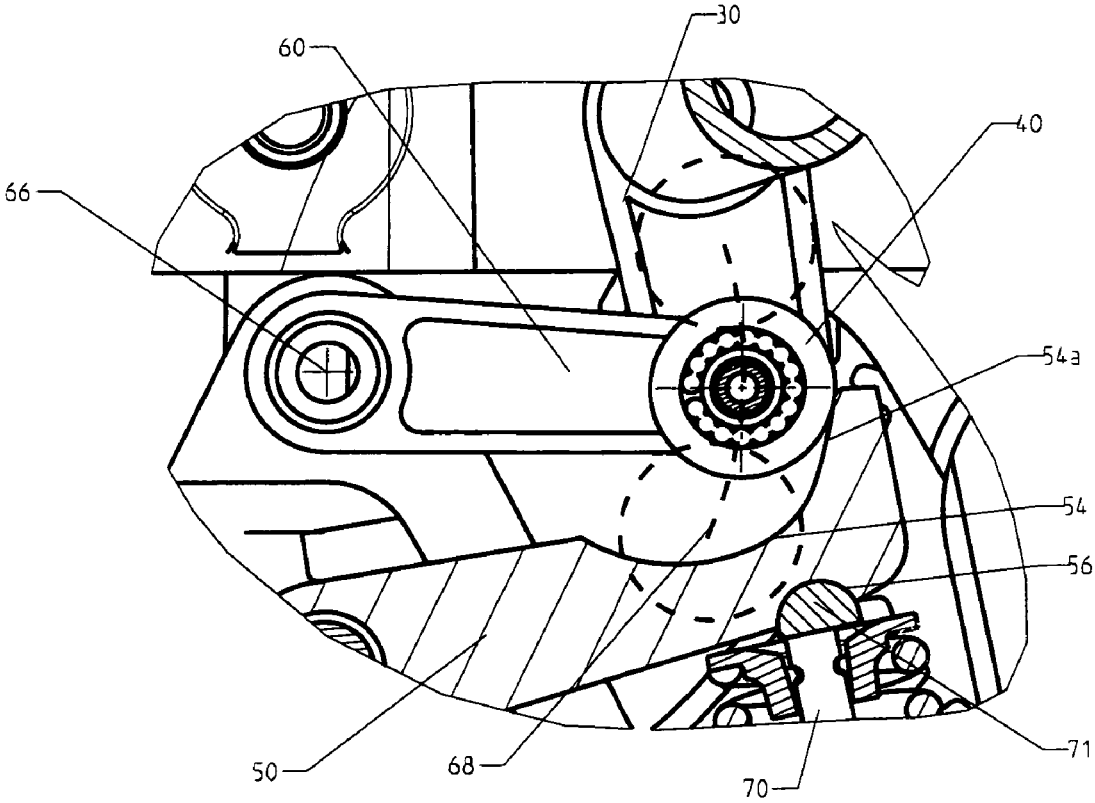

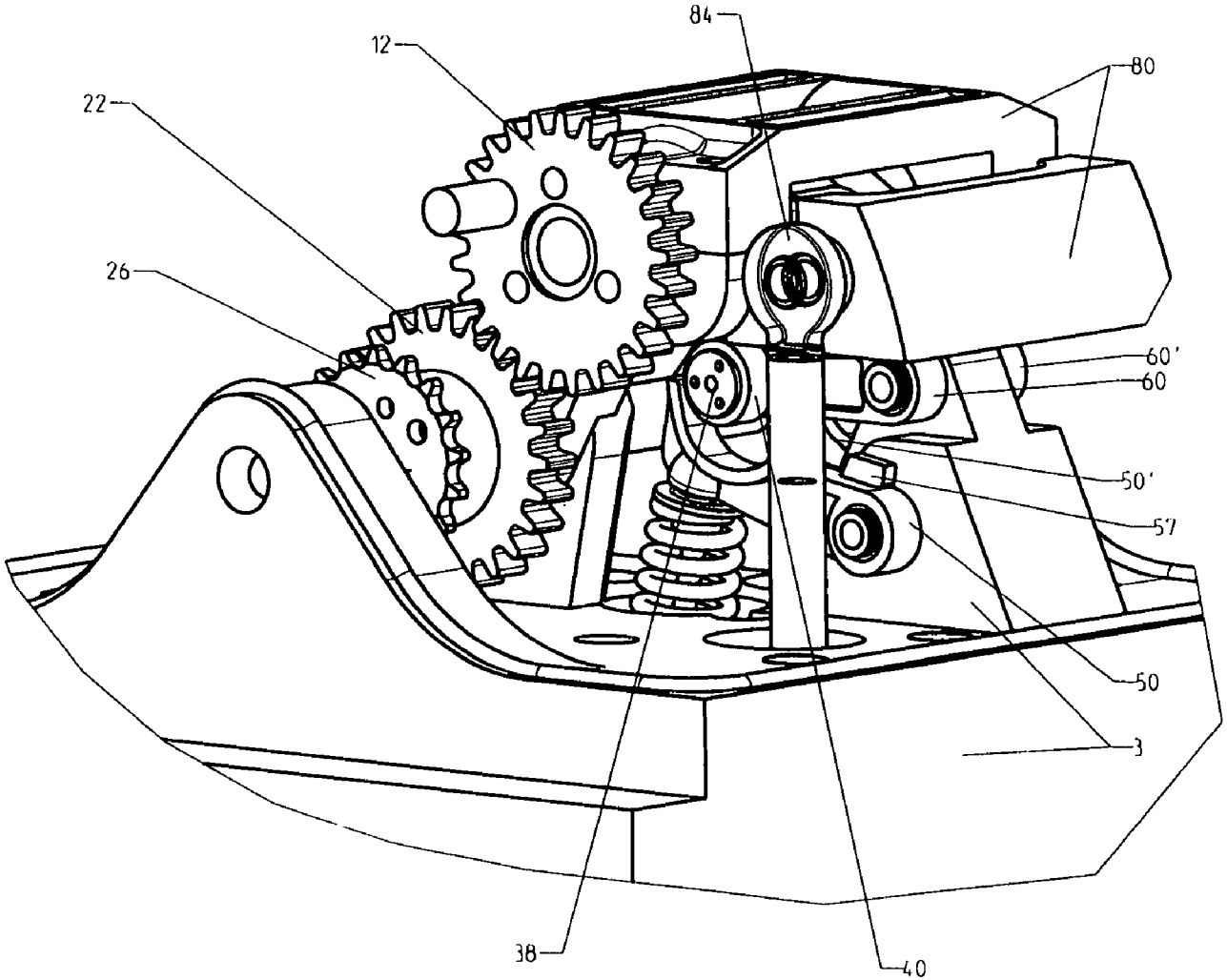
Figur 5

Figur 6
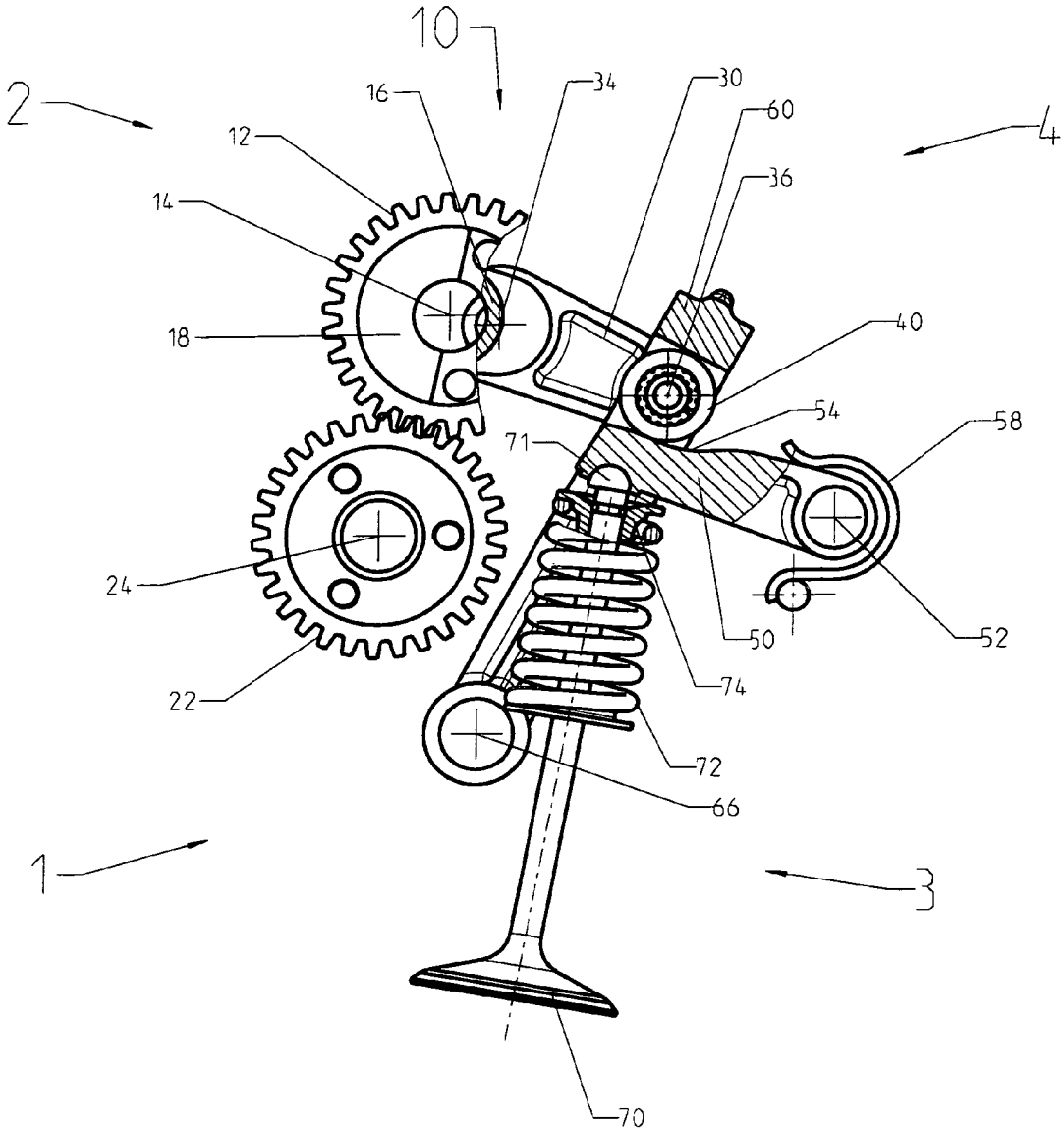

Figur 7
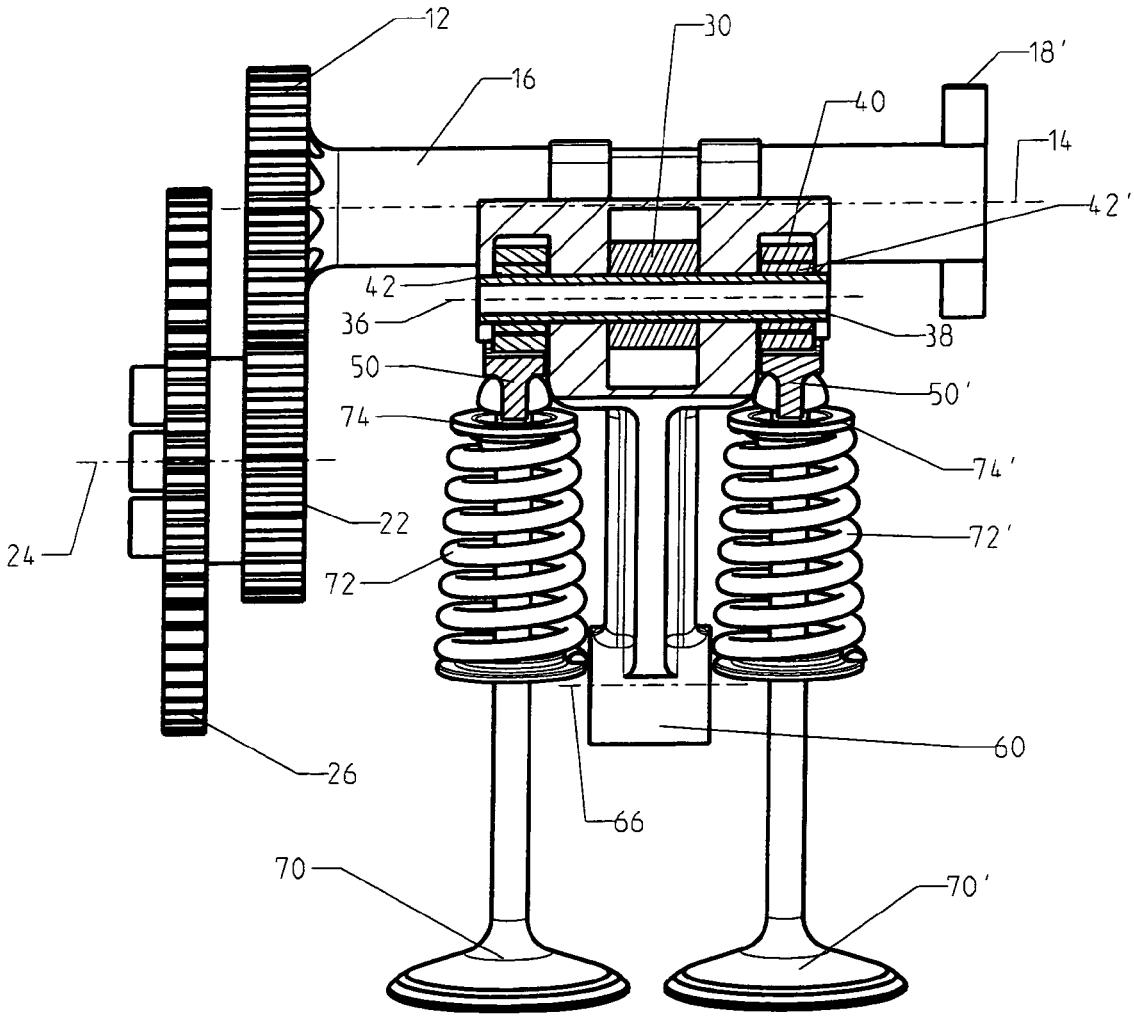

Figur 8
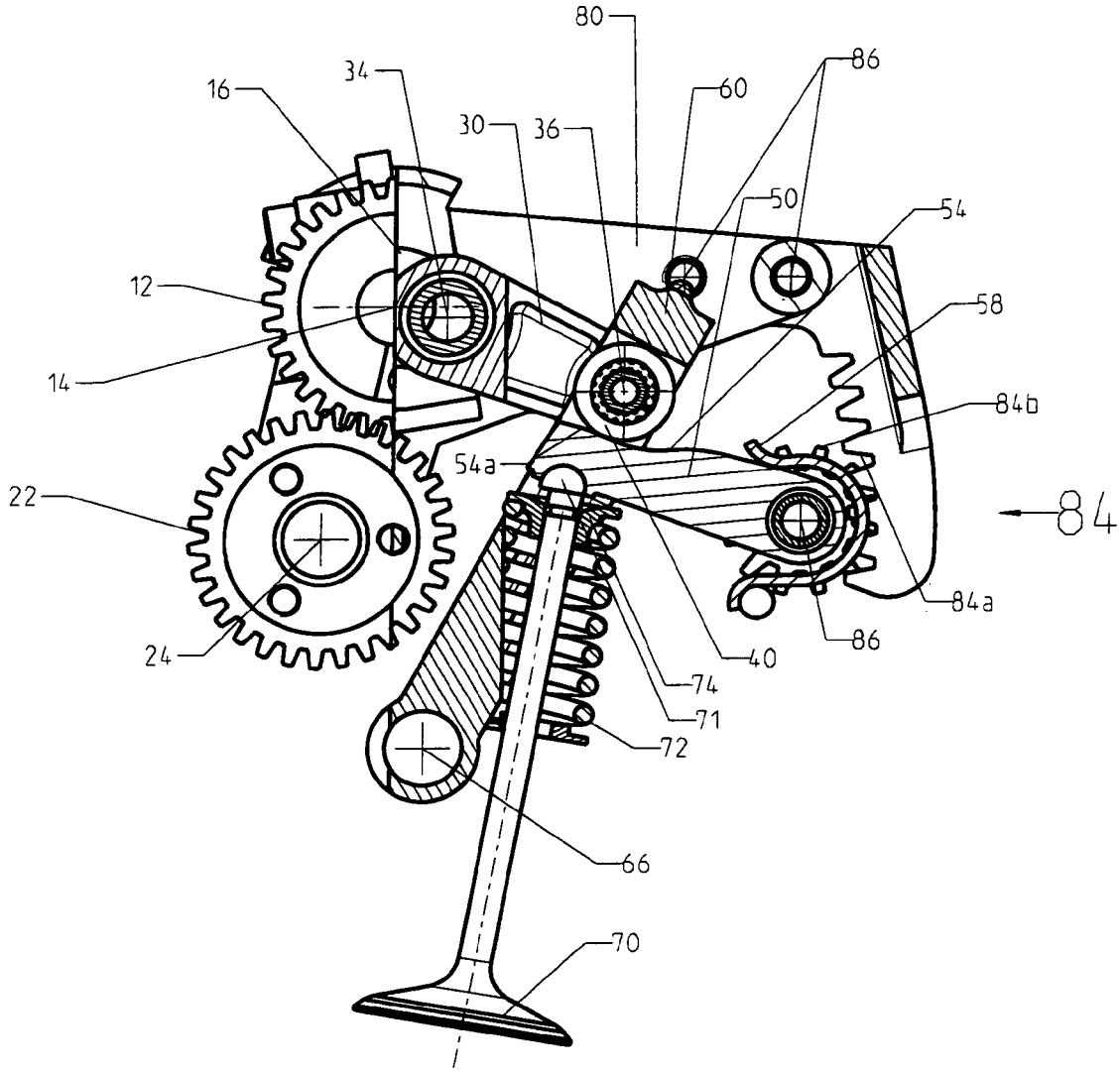

Figur 9
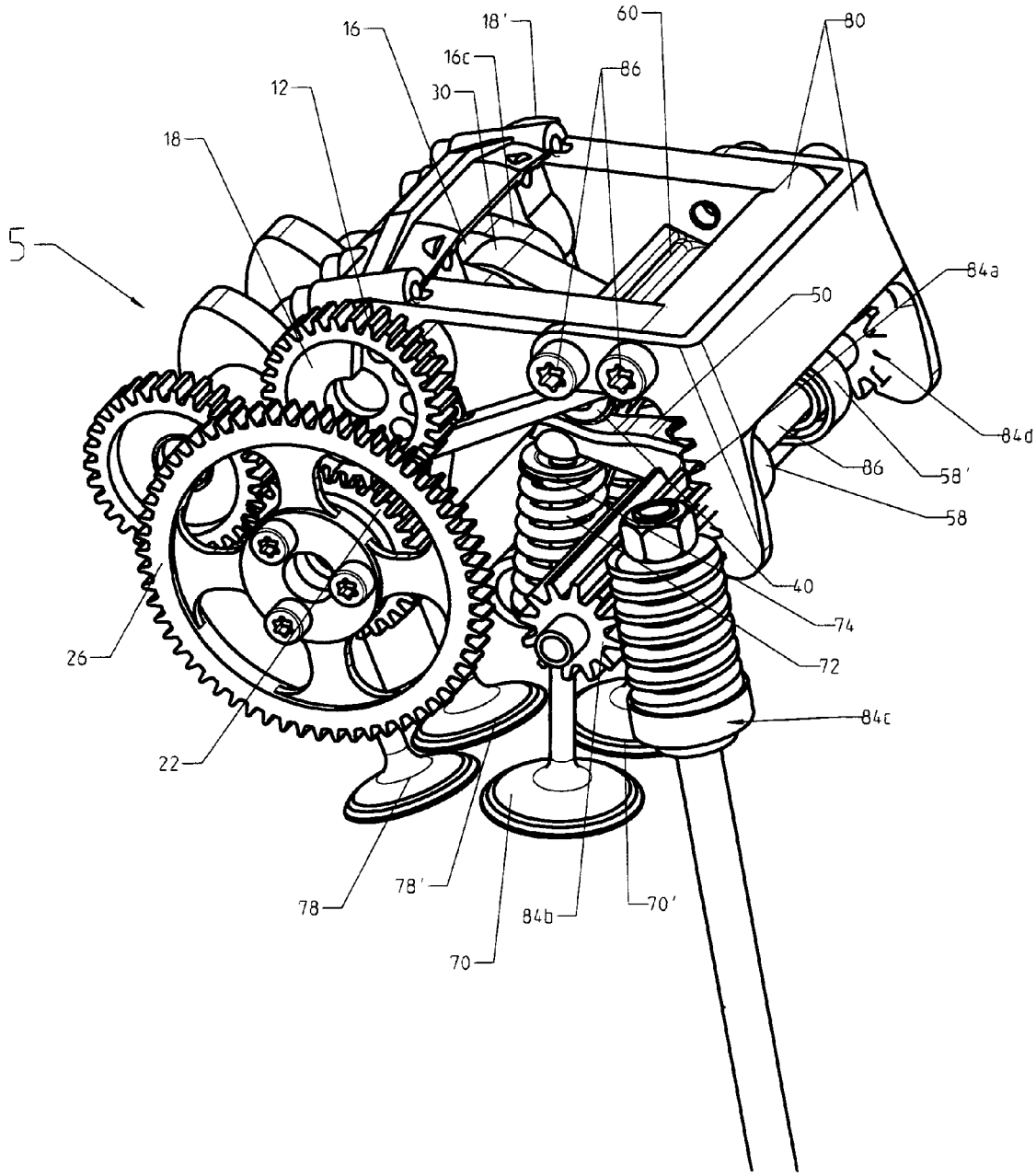

Figur 10a
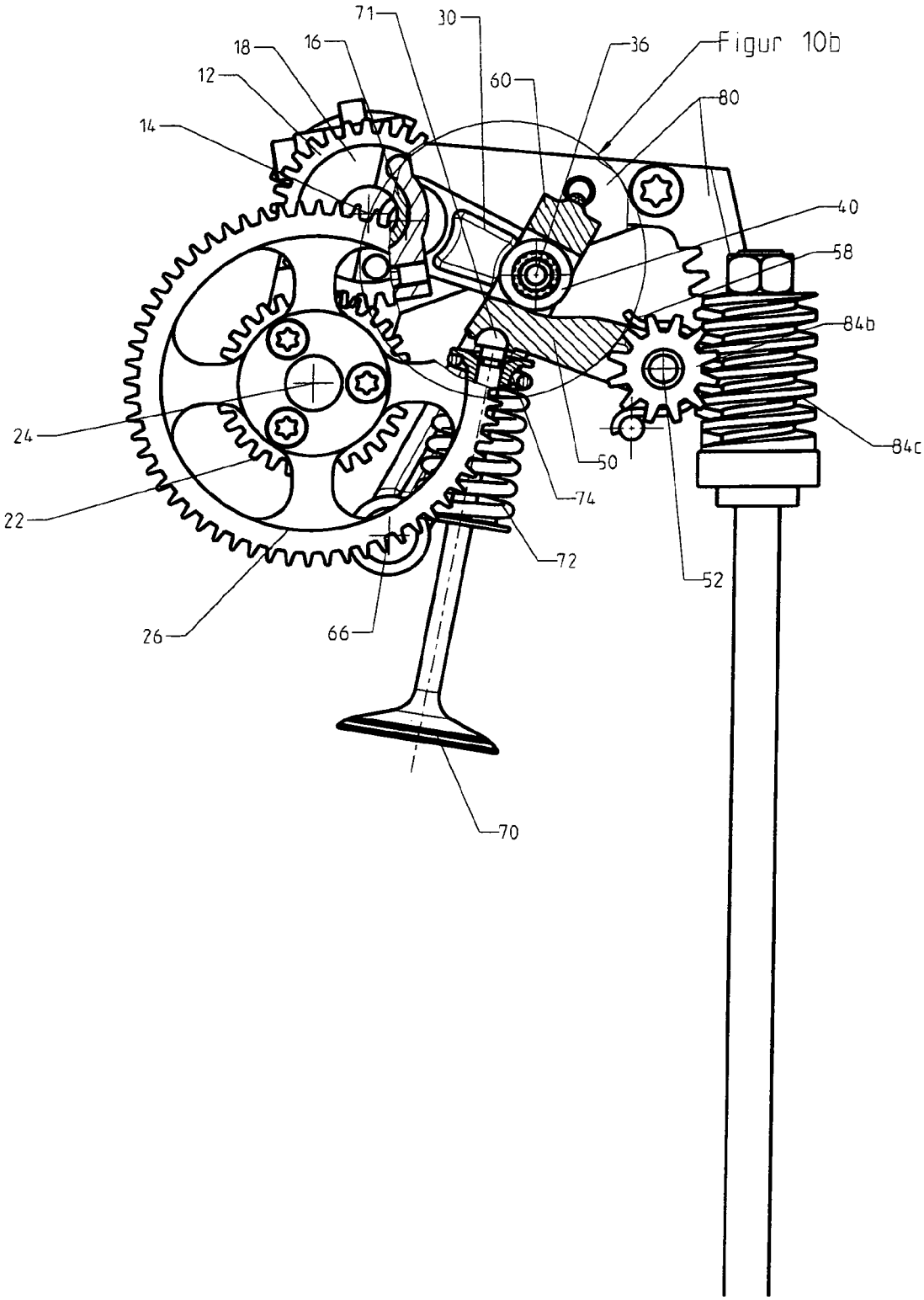

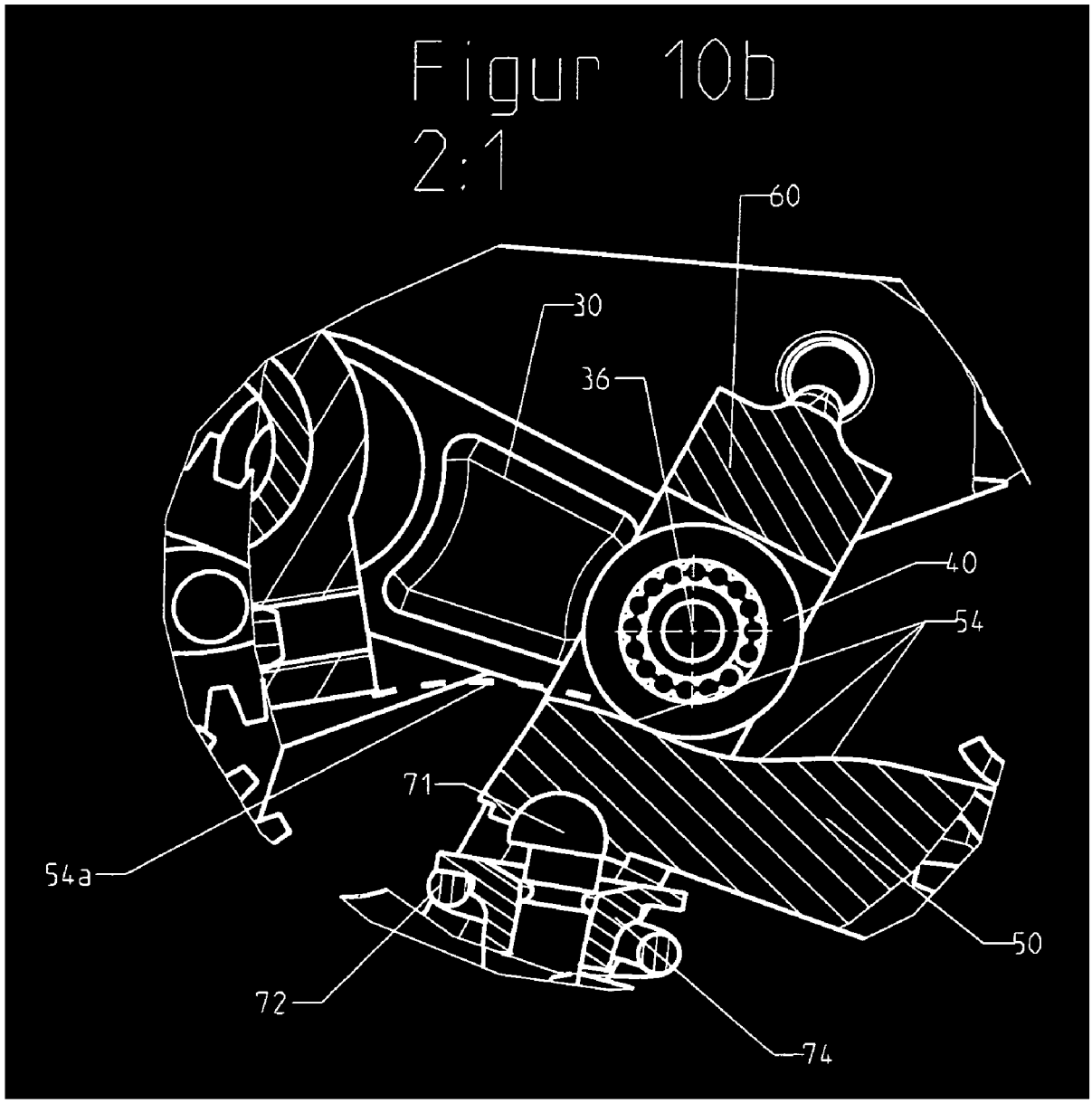
Figur 10b
2:1
60
30
36
40
54
71
54a
50
72
74

Figur 11
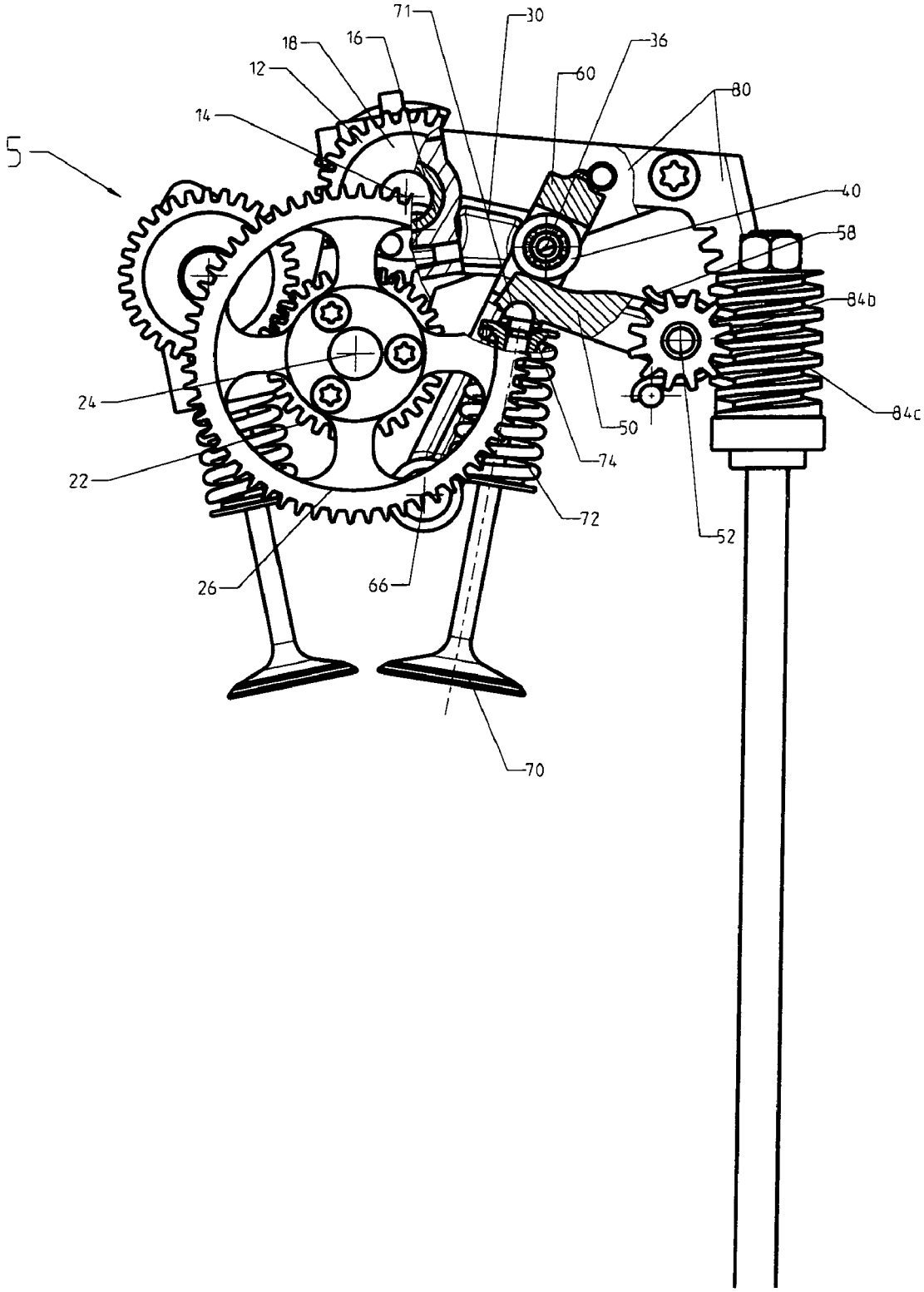

Figur 12
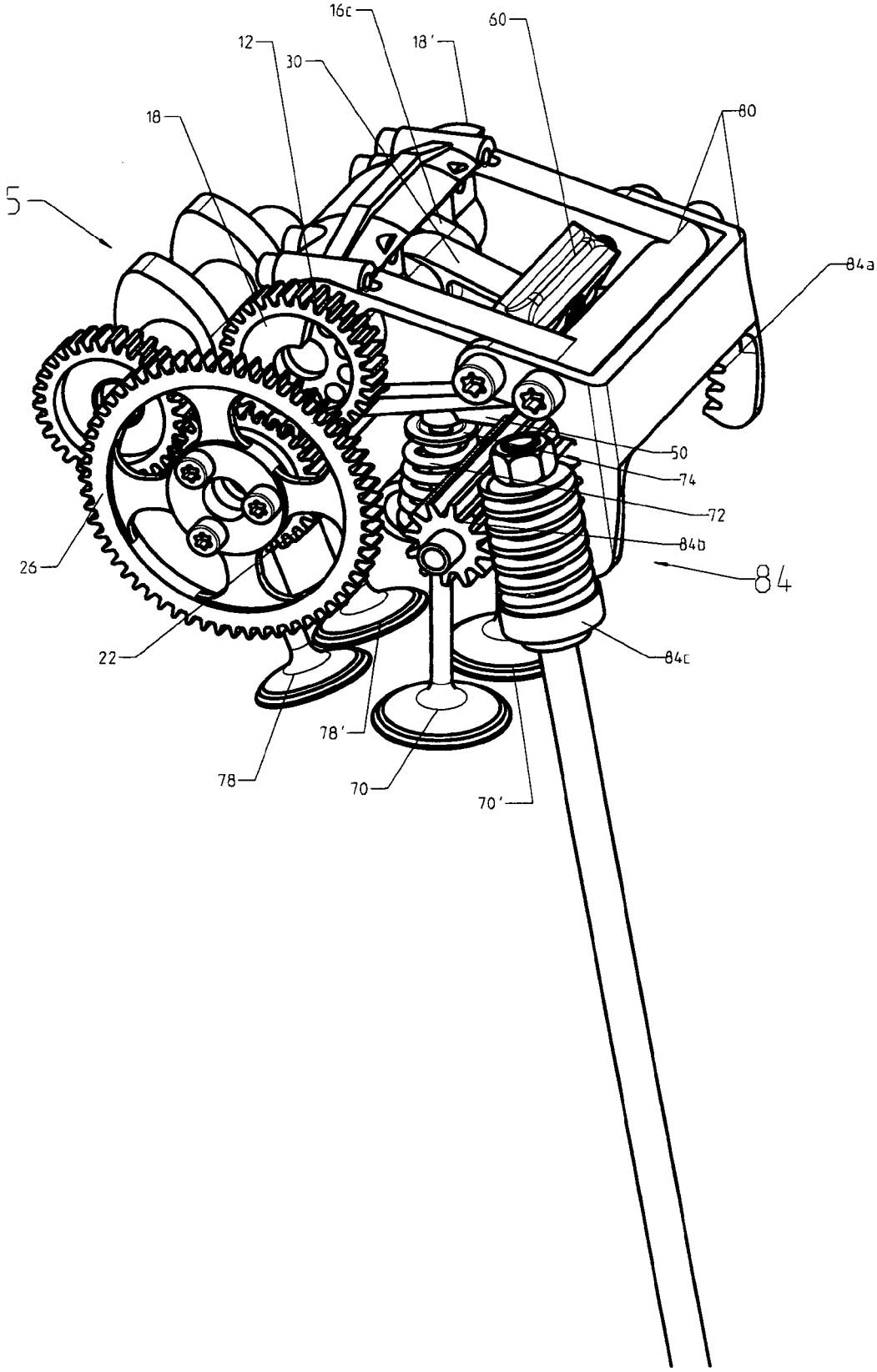

Figur 13a
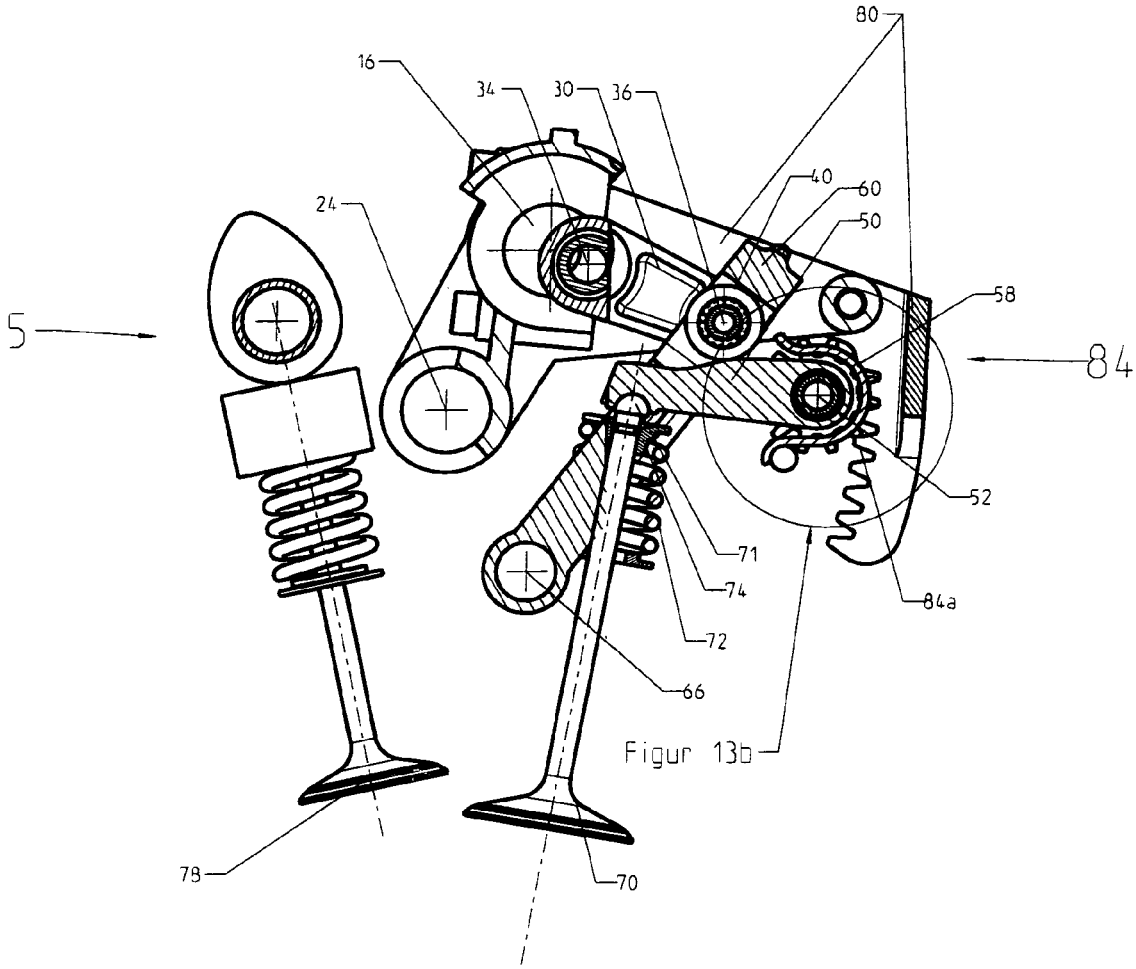

Figur 13b
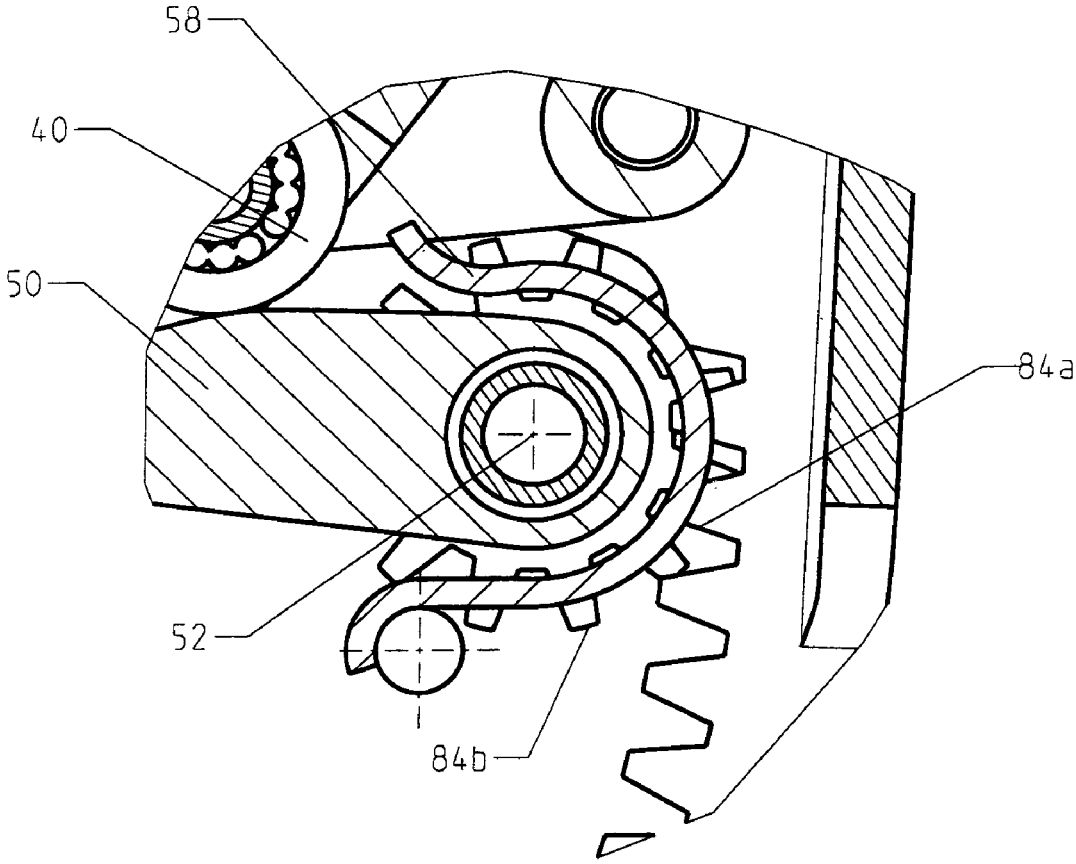

INTERNAL COMBUSTION ENGINE COMPRISING A VARIABLE VALVE DRIVE

BACKGROUND OF THE INVENTION

1. Field of the Invention

The present invention relates to a combustion engine, in particular to a combustion engine with a valvetrain. In particular, the present invention relates to a combustion engine with a valvetrain with variable valve control.

Typically, in combustion engines, valvetrains are provided that generate a valve lift of fixed lift height and duration using a camshaft. The inflow by volume of the air fuel mixture is controlled by a throttle valve. Such a valvetrain, however, has disadvantages regarding an optimal adjustment to different load regimes of the combustion engine. Such disadvantages can at least partially be avoided by a valvetrain of variable valve lift.

2. Description of the Related Art

Valvetrains with variable valve lift are known in the art. The Valvetronic system of BMW, for example, is a valvetrain with variable valve lift, which is being produced in series. It allows a variable adjustment of valve lift and duration of valve opening in response to a number of drive parameters, such as rotational speed and the position of the throttle control. Further, valvetrains with variable valve lift are known for motors of low rotational speed with cam in block. Cam-in-block motors, however, generally have a number of disadvantages, in particular in the regime of high rotational speed. For example, relatively large masses generally need to be moved when opening and closing the valve.

Further, EP 1 350 928 describes an apparatus for smoothly varying the valve lift in combustion engines. Therein, a linear cam is pushed more or less deeply between two rollers by an actuating member, wherein one of the rollers is movable in the sense of the valve lift. Thereby, a lift curve on a roller, mounted in a rocker level or another actuating member towards the valve, actuates the valve lift.

A further valvetrain for a combustion engine is described In U.S. Pat. No. 5,357,915. The valvetrain described therein allows modifying the valve synchronization and the valve lift of the intake and exhaust valves, which are driven by rocker arms and overhead camshafts.

PCT 2002/053881 describes a variably adjustable mechanical valve gear for a gas-reversing valve with a closing spring on a piston engine, in particular a piston-type internal combustion engine, comprising a driving mechanism for generating a lifting movement that is effective counter to the force of the closing spring on the gas-reversing valve and a stroke transfer means arranged between the driving mechanism and the gas-reversing valve, which acts upon the gas-reversing valve in the direction of its movement axis and for which the stroke distance can be adjusted in the direction of the movement axis via an adjustable guide element and which is realized with a pivoting element that is connected with its end facing away from the gas-reversing valve to the driving mechanism and is guided so as to pivot back and forth on the guide element designed as control curve.

Further, FR 1 284 700 describes a valvetrain for combustion engines, which allows to adjust automatically the duration of the valve lift and the lifting height of the valves, in order to adapt them to the rotational speed.

A valvetrain for a motor according to EP 1 515 008 is composed as follows: An intermediate rocking element is interposed between a pivoting earn surface and a rocking surface of a rocking arm. By shifting of contact spots an opening duration and an opening height of the valve can be adjusted continuously.

DE 23 35 634 relates to a valve adjustment for combustion engines, comprising a driving shaft, an arrangement for transforming the rotational movement to a pivotal movement actuating the valve, and an arrangement for modifying the valve lift in response to the rotational speed and the load of the combustion engine.

U.S. Pat. No. 6,684,832 describes a valvetrain of a combustion engine, which allows modifying the lift and the opening and closing angle. To this purpose, the camshaft is not mounted fixedly on the cylinder head, but it oscillates about an axis, and by this oscillation the valve lift and duration of valve opening are modified.

The valvetrains mentioned above, however, are deficient in several respects, for example regarding their space requirements, their weight, susceptibility to wear, and limitations of the variability of the valve control.

The present invention attempts to reduce at least some of the above-mentioned problems. Further, the present invention attempts to provide a combustion engine, which has good properties with respect to motor performance, wear, and/or other aspects. The object is solved by a combustion engine according to independent claim 1. Further advantages, features, aspects and details of the invention as well as preferred embodiments and particular aspects of the invention are evident from the dependent claims, the description and the drawings.

BRIEF SUMMARY OF THE INVENTION

The Combustion engine has a valvetrain for actuating a valve, the valvetrain being arranged in the cylinder head portion, wherein the valvetrain comprises a first driving member, which is rotatable about a first rotation axis; a connecting rod with a first joint and a second joint, and a guiding member for guiding the connecting rod, the guiding member being pivotable about a guiding member axis. The connecting rod is joined with its first joint to the first driving member, and is joined with its second joint to the guiding member. The position of the first rotation axis is adjustable in relation to the cylinder head. Preferably, the connecting rod and the guiding element are members of a gear or transmission, which is coupled to the first driving member in order to transmit a rotational movement of the first driving member into a lifting movement for actuating the valve.

The connecting rod allows transforming the rotational movement of the first driving member into a lifting movement, by which the valve is actuated. The guiding member allows avoiding an unwanted pivoting of the connecting rod about the first connecting rod joint, whereby a directed transmission of the force from the connecting rod to the valve can be achieved. Further, thereby the susceptibility to wear of the valvetrain can be reduced. Further, by having the position of the first rotation axis adjustable, an additional degree of freedom of the valvetrain is created, which can be used for adjusting various properties of the valvetrain.

According to a further preferred aspect of the invention, the valvetrain further comprises a second driving member for driving the first driving member, wherein the second driving member is preferably arranged in the cylinder head portion. The second driving member is rotatable about a second rotation axis.

According to a further preferred aspect, the valvetrain comprises a pushing member for transmitting a lifting movement of the connecting rod for actuating the valve, wherein the pushing member is fastened or joined to the connecting rod or to the guiding member. Preferably, the pushing member is joined rotatably or pivotably. According to a particularly preferred aspect, the pushing member is a roller. Thus, energy loss or wear due to sliding friction can be reduced.

According to a further preferred aspect, a transmission member is in mechanical and preferably in releasable mechanical contact with the pushing member. The transmission member allows a force exerted by the pushing member to be transmitted for actuating the valve. Further, a desired valve lifting curve can be approximated by a suitable design of the transmission member.

According to a further preferred aspect, the transmission member is biased by a forcing member, e.g. by a spring or a spring-like member, towards the valve. Thus, a non-positive connection between the transmission member and the valve can be promoted by the forcing member, hence an unwanted mechanical play of the transmission member can be limited.

According to a further preferred aspect, a hard stop defines a maximum displacement of the transmission member. The maximum displacement defined in this manner is preferably directed away from the valve. It is further preferred that the fixed stop is stationarily arranged in the cylinder head. It is further preferred that the stop is adjustable. By means of the stop, an unwanted mechanical play of the transmission member can be limited.

According to a further preferred aspect, the transmission member is a lever, which is pivotable about a lever axis; it is particularly preferred that the lever is a one-arm lever. Thus, an advantageous force transmission between the pushing member, the transmission member and the valve can be achieved, and a stable mounting of the transmission member can be provided.

According to a further preferred aspect, the transmission member has a valve pushing surface for actuating the valve and/or for mechanical contact of the valve. The valve pushing surface allows transmitting to the valve a pushing force generated by the pushing member.

According to a further preferred aspect, a movement of the pushing member toward the lever axis and/or a sliding or rolling of the pushing member along a pushing receiving surface of the lever toward the lever axis causes the valve to open. This arrangement allows for an advantageous load of the mounting of the lever about the lever axis.

According to a further preferred aspect, the valve is an intake valve. According to a further preferred aspect, the combustion engine comprises a second intake valve, wherein preferably both intake valves are associated to the same piston chamber. The valvetrain is preferably adapted such that both valves are actuated in the same or similar manner, such that e.g. a same or similar valve lift behaviour and/or a same or similar valve lift curve is generated. By the second intake valve, e.g. an improved supply of air-fuel-mixture and hence an increase of motor power can be achieved.

According to a further preferred aspect, a valve lifting curve and/or a quantity characterizing the valve lifting behaviour is adjustable by the adjustment of the position of the first rotation axis. Thereby, e.g. a magnitude of valve lift and/or a duration of the valve opening is adjustable. Herein, the duration of the valve opening is in terms of the motor cycle and is, hence, defined e.g. in terms of the rotational angle of the crankshaft. Thus, a variable valve actuation control e.g. depending on the load can be achieved.

According to a further preferred aspect, the first driving member is rotatable synchronously to a motor cycle of the combustion engine, such that there is a phase relation between the rotational angle of the first driving member and a phase angle of the engine cycle. By the adjustment of the position of the first rotation axis, the phase relation is adjustable. Hence, different aspects of the valve actuation can be designed variably, in particular a phase relation of the valve actuation in relation to the motor cycle.

According to a further preferred aspect, a phase of the valve lifting behaviour relative to the motor cycle of the combustion engine is adjustable by the adjustment of the position of the first rotation axis. According to a further preferred aspect, there is a phase relation between the rotational angle of the first driving member and half of the rotational angle of the crankshaft of the combustion engine, and by the adjustment of the position of the first rotation axis, the phase relation between the rotational angle of the first driving member and the half rotational angle of the crankshaft is adjustable.

According to a further preferred aspect, the pushing member is guided on a guided path, and preferably the guided path of the pushing member is adjustable by the adjustment of the position of the first rotation axis. This allows a variation of the valve lifting behaviour.

According to a further preferred aspect, the adjusting of the position of the first rotation axis is a pivoting of the first rotation axis about a pivoting axis. Preferably, the pivoting axis is also the second rotation axis. Thereby, the distance between the first rotation axis and the second rotation axis can be held constant during pivoting, which may result in advantages with respect to the interaction of first and second driving member, in particular if the interaction is by means of two meshing gearwheels.

According to a further preferred aspect, the valvetrain comprises a pivoting drive for pivoting the first driving member. The pivoting drive comprises a pivoting drive gearwheel, which is rotatable about a third rotation axis, and a pivoting drive gear segment, which is in meshing connection with the pivoting drive gearwheel. Preferably, the pivoting drive gear segment is fixedly connected to a pivoting member, in which the first driving means is mounted. Thereby, a stable mounting of the first driving means can be achieved.

According to a further preferred aspect, the valvetrain comprises a worm wheel or worm gear, which is in meshing connection with the pivoting drive gearwheel for driving the pivoting drive gearwheel. Thereby, e.g. the position of the first rotation axis can be held stably.

The third rotation axis is also the lever axis of the lever. This arrangement allows a compact structure of the valvetrain.

According to a further preferred aspect, the connecting rod and the guiding member are members of a linkage, preferably members of a pinned, and preferably planar linkage, particularly preferably a pinned linkage of four links. This allows an advantageous guiding of the connecting rod.

According to a further preferred aspect, the valve is an intake valve, and the second driving member also actuates an exhaust valve. This promotes a coordinated actuation of intake and exhaust valve.

According to a further preferred aspect, a maximum valve lift of the valve is at least 5 mm, preferably at least 7 mm, further preferably at least 10 mm, particularly preferably at least 12 mm, and especially particularly preferably at least 15 mm. This allows achieving a high power output of the combustion engine.

The combustion engine can be used particularly advantageously in devices or vehicles with high rotational speeds of the engine, for example in motorcycles. It can further be used in cars, trucks, airplanes, or watercrafts.

According to a preferred aspect of the invention, the valvetrain can be subdivided into an active subsystem, which is connected positively to the first driving member, and into a passive subsystem, which is connected only non-positively to parts of the active subsystem. Preferably, the first driving member, the connecting rod, and the guiding member and, if applicable, the pushing member, are associated to the active subsystem. Further, preferably the valve and, if applicable, the transmission member are associated to the passive subsystem. The non-positive connection allows designing the valvetrain such that a certain valve clearance is possible, and that manufacturing tolerances or thermal expansion can be compensated.

BRIEF DESCRIPTION OF THE DRAWINGS

Embodiments of the invention are shown in the Figs. and are described in more detail in the following.

FIG. 1 shows a cross-sectional site view of a first embodiment of a valvetrain according the invention;

FIG. 3 shows a cross-sectional side view of an embodiment of a valvetrain according to the invention including a pivoting frame;

FIG. 4 shows an enlarged portion of a part of FIG. 3;

FIG. 5 shows a perspective view of the valvetrain of FIG. 3;

FIG. 6 shows a cross-sectional side view of a further embodiment of a valvetrain according to the invention;

FIG. 7 shows a cross-sectional front view of the valvetrain of FIG. 6;

FIG. 8 shows a cross-sectional side view of a further embodiment of a valvetrain according to the invention;

FIG. 9 shows a perspective view of the valvetrain of FIG. 8;

FIG. 10*a* shows a further cross-sectional side view of the valvetrain of FIG. 9;

FIG. 10*b* shows an enlarged portion from FIG. 10*a;*

FIG. 11 shows a further cross-sectional side view of the valvetrain of FIG. 9;

FIG. 12 shows a perspective view of the valvetrain of FIG. 9, which is adjusted for small valve lift;

FIG. 13*a* shows a side/cross-sectional view of the valvetrain of FIG. 12;

FIG. 13*b* shows an enlarged portion from FIG. 13*a;*

DETAILED DESCRIPTION OF THE INVENTION

Figure 1B:
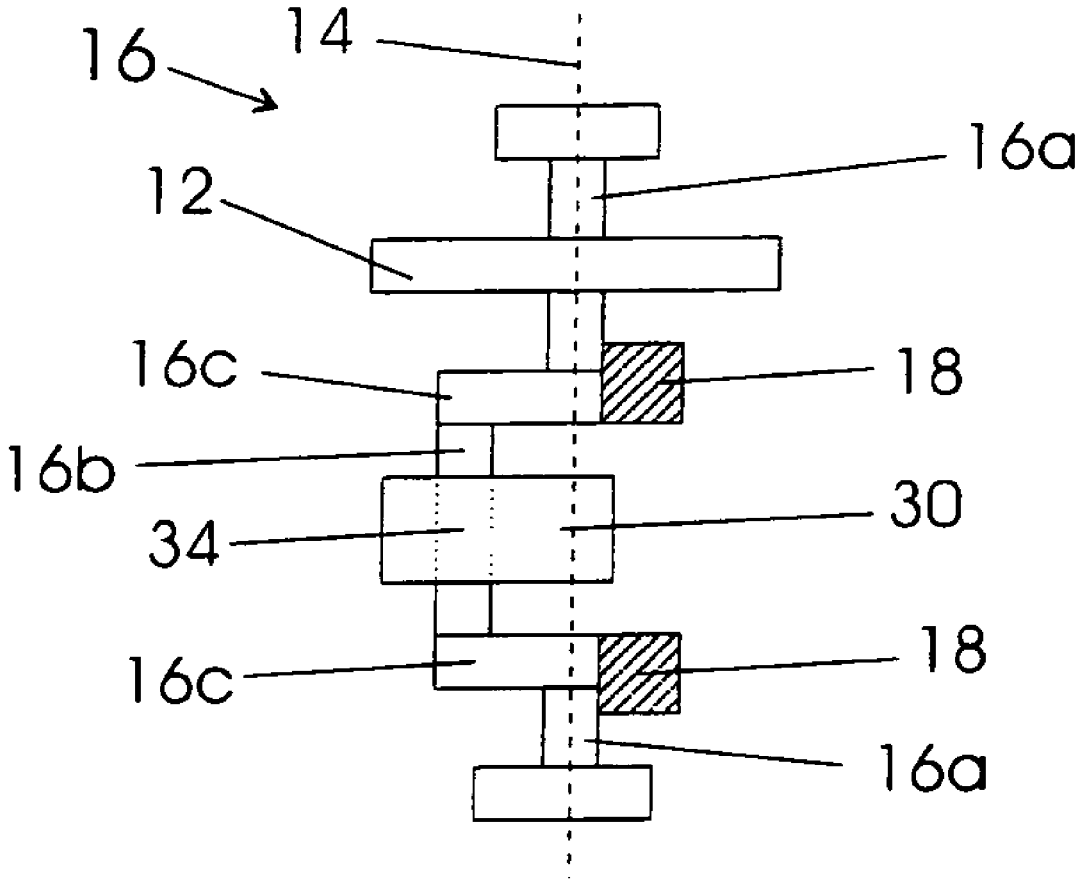
FIG. 1*b* shows a schematic view of the valve crank of the valvetrain of FIG. 1.

An embodiment of a combustion engine 1 according to the invention with a valvetrain 2 is shown, in a cross-sectional side view, in FIG. 1.

Herein, the shaded area 3 represents the cylinder head; also, the structures 3*a*, 3*b* mounted fixedly thereon represent parts of the cylinder head. Not shown in FIG. 1 are further parts of the combustion engine 1, which are mounted below the cylinder head 3, such as combustion chamber, piston and crank shaft, which are arranged in a usual manner.

The valvetrain 2 is shown in the upper portion of FIG. 1. The valvetrain 2 comprises a driving system 10 and a transmission unit or gear unit 4. The driving system 10 provides a rotational movement. The rotational movement is preferably synchronous to the motor cycle of the combustion engine, so that one full rotation corresponds to one full motor cycle, and it is particularly preferred that the rotational movement is driven by the crank shaft of the combustion engine 1. The transmission unit 4 transmits the rotational movement of the driving system into a lifting movement for actuating the valve 70. An actuation of the valve is herein understood to be a lifting movement of the valve 70, which opens and/or closes the valve 70, preferably synchronous to the motor cycle.

The driving system 10 comprises a driving gearwheel 22, a valve crank gearwheel 12, and a valve crank 16. The driving gearwheel 22 is mounted stationarily in the cylinder head 3*b* and rotatably about a driving axis 24. The valve crank gearwheel 12 is fixedly connected to the valve crank 16. The valve crank 16 and the valve crank gearwheel 12 are rotatably mounted about a valve crank axis 14. Here and in the following, the term "axis" means a geometrical axis and/or a rotational axis. The bearing of the valve crank 16 is not shown in FIG. 1.

Although the detailed driving mechanism of the driving gearwheel 22 is not shown in FIG. 1, any driving mechanism suitable for a camshaft is also suited for the driving gearwheel 22, for example a gear unit, a chain drive, sprocket, drive belt, gearwheel, or spur gear. The driving gearwheel 22 is driven by a crank shaft of the combustion engine 1. The driving is synchronous to the motor cycle, i.e. a full rotation of the driving gearwheel 22 corresponds to a motor cycle. In a four stroke engine, this is the case if the transmission between crank shaft and driving gearwheel is 2:1.

The driving gearwheel 22 is in meshing connection with the valve crank gearwheel 12. The transmission ratio between driving gearwheel 22 and valve crank gearwheel 12 is 1:1. Thereby, also the valve crank gearwheel is driven synchronously to the motor cycle. Here and in some of the following Figs., the meshing connection of this and of other gearwheels is partially shown in a displaced manner. Nevertheless, the Figs. are to be understood in that the teeth of one of the gearwheels mesh into the notches of the other gearwheel.

FIG. 1*b* is a schematic top view of the valve crank 16 shown in FIG. 1. As shown there, the valve crank 16 comprises a bearing pin 16*a*, which is arranged along and is rotatable about the valve crank axis 14, a lifting pin 16*b*, which is arranged parallel and eccentric to the valve crank axis 14, and a radial element 16*c*, which connects the bearing pin 16*a* and the lifting pin 16*b* to each other. Further, the valve crank gearwheel 12 is mounted fixedly on the bearing pin 16*a* of the valve crank 16. The valve crank 16 is mounted, by means of the bearing pin 16*a*, in a rotational bearing (represented by boxes at the upper and lower end of the valve crank 16), such as to be rotatable about the valve crank axis 14.

A connecting rod is joined to the lifting pin 16*b* of the valve crank 16, i.e. connected via a joint 44 to the valve crank 16. Consequently, the connecting rod 30 is pivotable or rotatable around the lifting pin 16*b* about a rotational axis defined by the joint 34. This rotational axis is parallel and eccentric to the valve crank axis 14. By means of the arrangement shown here, a preferred general aspect of the invention is illustrated, namely that the connecting rod is joined with its joint 34 to the valve crank 16 eccentrically to the valve crank axis 14, and/or that the connecting rod joints 34 and/or 36 are swivel joints.

Further, compensating mass elements 18 are arranged on the side of the valve crank 16 opposing the lift pin 16*b* with respect to the valve crank axis 14. The compensating mass elements 18 generally serve the purpose of partially compensating for an imbalance of the valve crank 16, which can be caused by a force transmitted from the connecting rod 30 to the valve crank 16. They are arranged, relative to the first rotational axis, opposite of the connecting rod 3D, and serve the purpose of reducing an imbalance of the rotation of the valve crank caused by the connecting rod 30.

Also in other embodiments, such a compensating mass element or compensating mass elements can be arranged on the valve crank or on the driving member 16 opposite the connecting rod. Preferably, they have a mass for reducing the imbalance of the driving member 16 caused by the connecting rod 30 by about 40%, 50%, 70% or 100%, or for reducing the imbalance by a percentage, which lies in an interval between two of these numbers. The arrangement and the purpose of the compensating mass elements 18 are analogous to the arrangement and purpose of compensating mass elements of the crank shaft, which are known in the state of the art. In particular, it is desired to arrange two compensating mass elements 18 symmetrically about the connecting rod, in order to avoid an unwanted free moment or torsional moment. In FIG. 1*b*, the compensating mass elements 18 are mounted on the lifting pin 16*a* of the valve crank 16. Alternatively, the compensating mass elements can also be mounted in another manner on the valve crank 16 or on the valve crank gearwheel 12. For example, a compensating mass element can be mounted on the valve crank gearwheel 12.

As is further shown in FIG. 1, the connecting rod 30 comprises, besides the first joint or connecting rod end 34 described above, an additional second joint or connecting rod end 36 as well as a rod body, which fixedly connects the first joint 34 and the second joint 36.

The connecting rod 40 has generally (i.e. independent of the embodiment described herein) a short length, i.e. a length of less than 10 cm, preferably of less than 5 cm. A length of the connecting rod is hereby understood to be the distance between the first and the second joint 34, 36 and/or between an axis defined by the first joint 34 and an axis defined by the second joint 36. The short length of the connecting rod 30 allows an efficient use of the available space and, in particular, a small headroom of the valvetrain 2 and a advantageous force transmission of the gear 4.

In order to guide the connecting rod, i.e. for example in order to reduce or disallow a free pivoting of the connecting rod 30 about the first joint 34, the connecting rod is joined, with its second joint 36, to a guiding member 60. Consequently, the connecting rod 30 is connected, pivotably about a joint axis defined by the joint 36, to the guiding member 60. Further, the guiding member 60 is mounted pivotably about a guiding axis 66. The bearing of the guiding member 60 is fixedly arranged in the cylinder head 3*a*. Thereby, the connecting rod 30 is guided: By the position of the second connecting rod joint 36 being restricted to a radius about the guiding axis, a free pivoting of the connecting rod 30 about the first connecting rod joint 34 is restricted and/or prevented.

It is a general aspect of the invention that the valvetrain 2 comprises a planar linkage with four links, and/or a pinned linkage of four links. Herein, the joints preferably comprise the driving axis 24, the guiding axis 66, the first connecting rod joint 34 and the second connecting rod joint 36. Further, the pinned linkage comprises the following links: firstly, the link between the guiding axis 66 and the driving axis 24 (by the cylinder head 3); secondly, the link between the driving axis 24 and the bearing of the connecting rod 30 on its first joint 34 (by the valve crank 16 or its lifting pin 16*c*); thirdly, the link between the first joint 34 and the second joint 36 of the connecting rod 30 (by the connecting rod 30); and fourthly, the link between the second joint 36 of connecting rod 30 and the guiding axis 66 (by the guiding element 60).

All elements of the above described linkage are positively coupled to each other, i.e. no independent movement of the elements with respect to each other is possible, or no such movement is possible that substantially influences the valve lift. In particular, because the guiding axis 66 is fixedly mounted in the cylinder head, and at a predetermined position of the valve crank axis 14, the rotational angle of the valve crank 16 is the only substantial degree of freedom of motion of the pinned linkage. Hence, in particular the movement and/or the geometrical arrangement of connecting rod 30 and guiding element 60 are determined by the rotational angle of the valve crank 16.

Further, FIG. 1 shows a roller 40. The roller is rotatably attached to the joint connection of the second connecting rod joint 36 with the guiding element 60. The roller 40, connecting rod 30 and guiding element 60 are connected by a transmission bolt, which is fixedly connected to the guiding element 60, and on which the connecting rod 30 as well as the roller 40 are mounted such as to be rotatable and/or pivotable about the axis defined by the connecting rod joint 36.

By means of the pinned linkage described above, the position and/or the movement of roller 40 (except for a rotational motion of the roller 40 about its rolling axis) are determined by the rotational angle of the valve crank 16. This results in the following general aspect of the invention, i.e. preferred aspect independent of the described embodiment, which is for example also illustrated in FIG. 4: The roller or pushing element 40 is moved along a guided path 68 by the rotational movement of the valve crank or the driving member 16. The guided path preferably defines a position of the pushing element 40 depending on the rotational angle of driving member 16. Particularly preferably, the guided path 68 is determined by the shape and the geometrical arrangement of valve crank 16, connecting rod 30 and guiding element 60. In the valvetrain of FIG. 1 and in the valvetrain of FIG. 4, the guided path 68 is for example along a segment of a circle about the guiding axis 66, which is limited by an upper and a lower turning point (dashed circles at the upper and lower ends of the guided path 68).

The valvetrain of FIG. 1 further comprises a transmission lever or rocker lever 50, which is mounted pivotably about a rocker lever axis 52. On the rocker lever 50, a rolling surface 55 is provided, along which the roller 40 can roll. Herein, the term "rolling" is to be understood to potentially also comprise a combination of rolling and sliding, i.e. generally the roller 40 will rotate, during its motion along the rolling surface 55, about its rolling axis; the rotation, however, can be such that also a partial sliding motion of the roller 40 along the rolling surface 54 occurs. Thereby, losses due to friction can be minimized. In particular, this is possible by dispensing elements having sliding friction, and by providing elements having rolling friction instead. Also, the requirements regarding the lubrication of the valvetrain are less critical.

In FIG. 1, the rocker lever 50 is pushed against the roller 40, so that a non-positive connection between rocker lever 50 and roller 40 is established. However, a maximum displacement of the rocker lever 50 towards the roller 40 is defined by the stopping element 57, so that the roller 40 can lift off from the rocker lever 50 if the roller 40 is moved further away from the rocker lever 50 than it would correspond to this maximum displacement.

By means of the non-positive connection between roller 40 and rocker lever 50, a position of the roller 40 predetermines a pivotal position of the rocker lever 50. Hence, the pivotal position of the rocker lever 50 is ultimately determined by the rotational angle of the valve crank 16. The exact relation between the rotational angle of the valve crank 16 and the pivotal position of the rocker lever 50 depends on the one hand on the form of the guided path 68 of roller 40 and, on the other hand, on the contour of the rolling surface 54 of the rocker lever 50.

Further, a valve 70 is shown in FIG. 1. The valve 70 comprises a cylindrical valve stem and a valve disc. The valve 70 is seated on a valve seat 76 in the cylinder head, and is thus shown in closed position. The valve 70 is connected via a spring seat 74 to a valve spring 72. The valve spring 72 is mounted in the cylinder head and pushes the valve 70 in a closed direction (i.e. upwardly in FIG. 1). The valve 70 is actuated as follows: it is pushed downwardly by a lifting movement against the force of the valve spring 72 along the valve axis (dashed line), and thus opened, and thereafter it is closed again by a lowering motion along the valve axis.

The valve contacts with its valve shaft the rocker lever 50 via a adjusting element 71. The rocker lever 50 is arranged such that it can open the valve 70, i.e. push it in an opening direction. Conversely, as long as the valve is opened, it is pushed by the force of the valve spring 72 against the rocker lever 50. Thus, a non-positive connection is established between the valve 70 and the rocker lever 50, and also between the rocker lever 50 and the roller 40. In contrast, when the valve is closed and seated in the valve seat 76, the valve stream 72 is not able to generate a non-positive connection between valve 70 and rocker lever 50 and/or between rocker lever 50 and roller 40.

The stopping element 57 is arranged such that it defines the maximum displacement of the rocker lever 50 to be about the displacement that corresponds to the closing of the valve 70. Thus, the rocker lever 50 and/or the adjusting element 71 is not able to lift off from the valve stem, even when the valve 70 is closed and no non-positive connection between valve 70 and rocker lever 50 is present.

In order to ensure the above described effect of the stopping element 57 in spite of typical manufacturing tolerances, the height of the adjusting element 71 can be adjusted. To that purpose, the adjusting element 71 is selected from a selection of elements of different height. The adjusting element 71 is inserted in the rocker lever 50 such as to be easily replaceable.

The height of the adjusting element 71 should herein still allow a certain play of the valve, which is desired or necessary in order to compensate a thermal expansion and/or manufacturing tolerances of the parts. The adjusting element 71 can be realized by different further elements, in particular by a screw element on the valve stern or by a hydraulic element (hydraulic tappet).

It is a general aspect of the invention that the valvetrain 2 is provided in a cylinder head 3 portion, as is exemplified in FIG. 1. A arrangement in the cylinder head portion 3 is to be understood as follows: The valve crank 16 is generally (i.e. in at least one possible position of the rotational axis 14 and/or in at least one pivotal position of a pivoting frame 80, as shown for example in FIG. 3), mounted on a cylinder head side relative to a dividing surface between motor block and cylinder head. Even if a cylinder head and a motor block should not be clearly distinguishable from one another in the combustion engine, such a dividing surface can be defined, for example, by a surface defined by the piston head, wherein the piston is in the top dead center position. According to this characterization, the valvetrain 2 corresponds to an overhead camshaft valvetrain, wherein the valve crank 16 corresponds to the camshaft.

The operation of the valvetrain shown in FIG. 1 is as follows: The valve crank 16 is turned by means of the driving gearwheel 22 and the valve crank gearwheel 12 synchronously to the engine stroke.

A rotational movement of the valve crank 16 about the axis 14 causes a lifting movement of the connecting rod 30. The lifting movement of the connecting rod 30 in turn causes a pivoting movement of the guiding element 60 about the guiding axis 66. Together with the lifting movement of the connecting rod 30 and/or with the pivoting movement of the guiding element 60, the roller 40 is moved periodically back and forth along the guided path 68 (see FIG. 4).

As long as the rocker lever 50 does not rest on the stopper 57, the roller 40 is in non-positive contact with the roller surface 54 of the rocker lever 50 and rolls on the roller surface 54. During the movement of the roller 40 along the roller surface 54 in direction of the rocker lever axis 52, the roller 40 pushes the rocker lever 50 downwards and forces thereby a pivotal motion of the rocker lever 50 towards the valve 70.

The path of the roller 40 is determined to be along the guided path 68. By the non-positive connection between roller 40 and rocker lever 50, each position of the roller 40 on its guided path 68 is assigned to a particular displacement of the rocker lever 50. This assignment results from the contour shape of the roller surface 54 in relation to the guided path 68.

The rocker lever 50 transmits the pushing force or displacement received from the roller 40 to the valve 70 and thereby pushes the valve 70 in an opening direction. A counterforce to this force is generated by the valve spring 72. The valvetrain 2 or the driving system 10 of the valvetrain performs work against this force.

During the opposite movement, i.e. the backwards movement of the roller 40 away from the rocker lever axis 52, the roller 40 allows a pivotal movement of the rocker lever 50 away from the valve 70. Thus, the valve spring 72 can close the valve 70 again.

By the described mechanism, the valvetrain 2 assigns to a given point in time of the motor cycle a rotational angle of the valve crank 16; which in turn determines a position of the roller 40 along its guided path 68; which in turn determines a pivotal position of the rocker lever 50; which in turn determines an associated valve lift of the valve 70. By the described chain of action, the valvetrain 2 assigns to each point in time of the motor cycle a valve lift.

The valvetrain 2 can be sub-divided according to the above description into an active sub-system and a passive sub-system. The active sub-system can be characterized as follows: The motional state of the active sub-system is substantially determined by the motional state of the valve crank 16, i.e. by a rotational angle of the valve crank 16 and by the position of the valve crank axis 14. The passive sub-system, in contrast, is characterized as follows: The motional state of the passive sub-system has, besides the motional state of the valve crank 16, further substantial degrees of freedom, which can influence the valve lift. The division into an active and, if applicable, a passive sub-system is independently of the shown embodiment a preferred general aspect of the invention, wherein it is particularly preferred that the valve crank 16 or the first driving means, the connecting rod 30, and the guiding element 60 are associated to the active sub-system. It is further preferred that the roller or pushing element 40 is associated to the active sub-system. The rotational movement of the roller 40 may represent a degree of freedom that is independent of the motional state of the valve crank 16, however this degree of freedom is not substantial for the valvetrain in the sense that it does not substantially influence the valve lift. Further, the valve 70 and, where applicable, the rocker lever or the transmission element 50 are preferably associated to the passive subsystem, since these elements are only non-positively connected to the active sub-system. For that reason, they principally have further own degrees of freedom of motion, which could, for example at extremely high rotational speeds, lead to the non-positive connection to be released.

Again independently of the described embodiment, it is, however, generally desired that the passive sub-system is provided or arranged such that the non-positive connection is largely conserved at the rotational speeds for which the combustion engine 1 is designed. Thereby, valve float can be largely avoided. To this purpose, it is a preferred aspect of the invention that the masses moved or accelerated by the valve spring 72, and/or the masses of the passive sub-system, are less than 200 gram, preferred less than 100 gram. Depending on the design of the valvetrain and on the materials used, these masses can be reduced down to 90 gram, down to 60 gram, or even down to 50 gram.

A reduction of the weight down to the stated lower weight limit is, for example, possible if titanium or (sheet) steel are used for the valve body, if aluminum or steel are used for the spring seat, and/or if a pneumatic spring is used as a valve spring. A further reduction in weight can be achieved by implementing the valve as a hollow valve stem valve.

Further, in various preferred embodiments, the mass that is to be moved by the force of the valve spring can be limited, such as to include only the mass of the valve 70, of the valve spring 72 (or a portion—generally half—of the mass of the valve spring 72), of the spring seat 74, and of the rocker lever 50.

Figure 2:
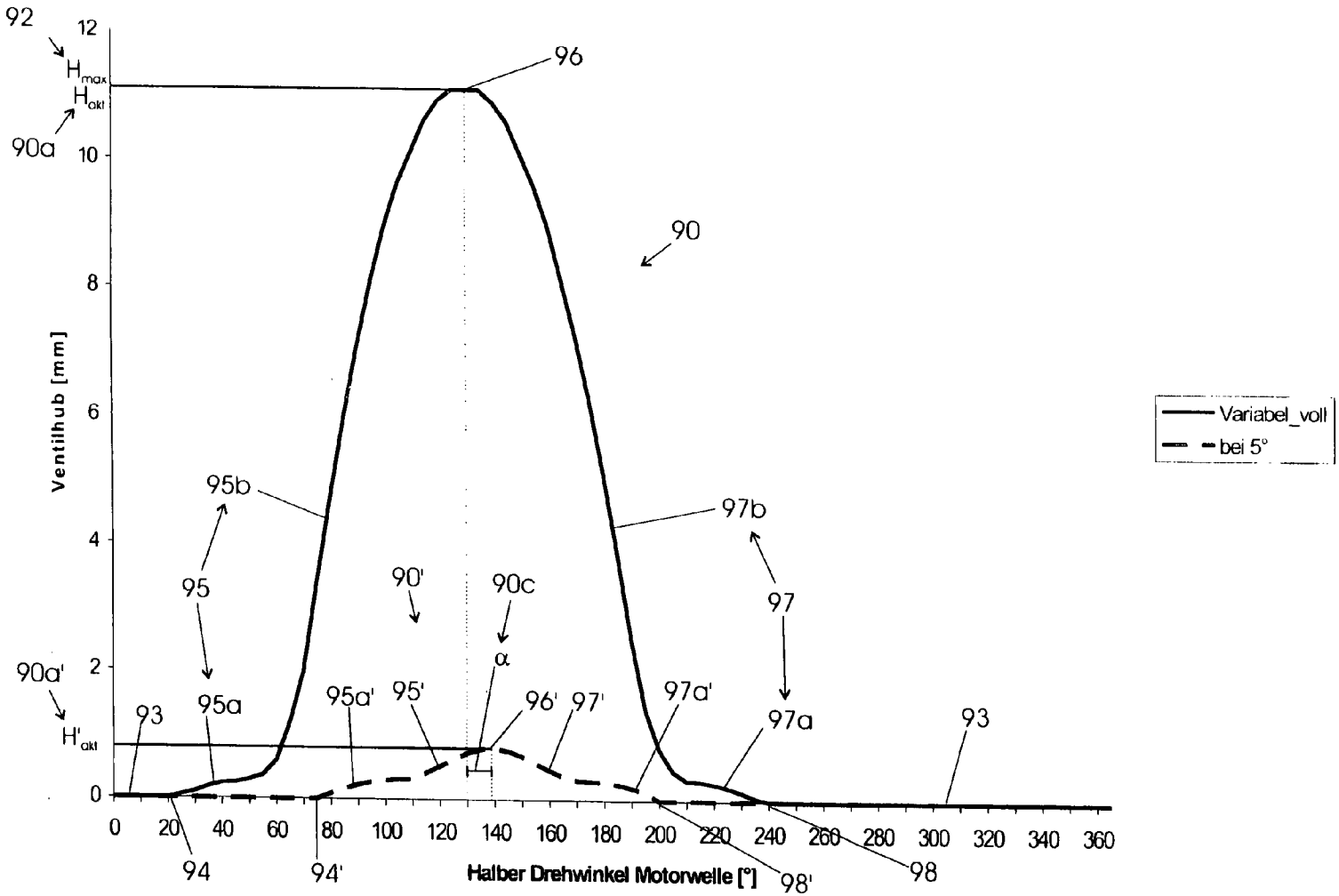
FIG. 2 shows an example valve lift diagram of a valvetrain according to the invention.

The lifting movement of the valve is typically divided into several different phases. These phases can be understood with the aid of the side view of the engine in FIG. 1 and FIG. 4 in connection with the valve lift curve 90 (solid line) shown in FIG. 2. Therein, the valve lift is shown in dependence of a point in time or a phase of the motor cycle. Here, the valve lift is the lifting displacement of the valve 70 along the valve axis in comparison to the closed position of the valve 70 in the valve seat 76. It should be noted that the valve lift diagram of FIG. 2 is shown by means of example and was not calculated from the embodiment shown In FIG. 1. Nevertheless, it has the same qualitative features as the valve lift diagram of the valvetrain of FIG. 1.

In a closed valve phase 93, the valve crank 16 is turned about the axis 14 in such a way that the roller 40 is located away from the rocker lever 50, i.e. that the roller 40 is not in contact with the roller surface 54. Hence, the valve 70 is closed, i.e. it is being pushed by the valve spring 72 into the valve seat 76, such that there is no valve lift.

Now, when the valve crank 60 is turned, then the roller 40 is moved by the connecting rod 30 along its guided path 68 towards the rocker lever 50 (i.e. downwards in FIG. 1), such that the roller 40 gets into contact with the rocker lever and rolls along the rolling surface 54, whereby it pushes onto the roller surface 54. Thereby, the rocker lever 50 is pushed and displaced towards the valve 70. The rocker lever 50, in turn, pushes the valve 70 against the force of the valve spring 72 and thereby forces an opening of the valve 70.

The further actuation of the valve could be subdivided into the following phases shown in the valve lift diagram of FIG. 2: after a point in time of opening of the valve 94, there follows an opening phase 95, which consists of an opening phase 95*a* of a little valve lift and a subsequent opening phase 95*b* of fast increasing of the valve lift. Subsequently, there follows the point in time 96 of maximum valve lift 90*a* or $H_{akt}$. Subsequently, there follows a valve closing phase, which is subdivided in analogy to the opening phase into a closing phase 97*b* of fast reduction of lift and a subsequent closing phase 97*a* of little valve lift. Subsequently, a point in time of closing of the valve 98 follows. Subsequently thereto, the valve closing phase 93 is repeated again. The opening duration is the period between opening 94 and closing 98 of the valve.

The phases 95*a* and 95*b*, or 97*a* and 97*b*, can be delimited from each other for example in that the phases 95*a* and 97*a* comprise a respective domain, in which the valve lift is less than a particular percentage (e.g. less than 50%, 66%, or 26%) of the maximally attainable lift height 92 or $H_{MAX}$, and that the phases 95*b* and 97*b* comprise respective domains, in which the valve lift is above these values. In accordance with the subdivision of the valve lift diagram into phases 93 and 95 or 97, the guided path 68 of the roller 40 can be subdivided into different portions: A closing portion, in which the roller 40 lifts from the roller surface 54, and an opening portion, in which the roller 40 contacts the roller surface 54. In accordance with the further subdivision of the phases 95 or 97, the opening portion of the guided path 68 or the roller surface 54 can be subdivided into still further portions, which are associated to the phases 95*a* and 97*a* or 95*b* and 97*b*. According to this subdivision, the phases 95*a* and 97*a* correspond to a first portion and the phases 95*b* and 97*b* to a second portion within the opening portion of the guided path 68 or the roller surface 54. Further, the part of the roller surface, on which the roller 40 hits the roller surface 54 at the opening point in time 94, is denoted in FIG. 4 as the hitting portion 54*a*. FIGS. 1 and 4 show the motional state of the valvetrain when the roller hits the roller surface 54, i.e. at the point of time of opening 94 (or—depending on the rotational direction of the valve crank—at the point of time of closing 98).

The shape of the valve lift diagram shown in FIG. 2 is essentially defined by the guided path 68 of the roller 40 and, in relation thereto, by the design of the profile of the roller surface 54. For a given guided path 68, a desired shape of the valve lift diagram can therefore be obtained or approximated by a corresponding design of the roller surface 54.

Regarding the shape of the valve lift diagram, it is on the one hand advantageous to have a fast opening of the valve, e.g. in order to secure a sufficient supply of air fuel mixture into the combustion chamber of the motor and hence to secure high motor power in the upper rotational speed regime. On the other hand, it is advantageous to have a smooth touchdown of the valve on the valve seat, because thereby a hard hitting of the valve 70 on the valve seat and a consequent mechanical strain of the parts can be reduced.

Therefore, it is advantageous if on the one hand the portion of the roller surface associated to the phases 95*b* and 97*b* is designed such that a fast opening of the valve occurs, i.e. that the gradient of the valve lift is as high as possible; and if on the other hand the portion of the roller surface, which is associated to the phases 95*a* and 97*a*, is designed such that a smooth closing of a valve occurs, i.e. that the gradient of the valve lift at closing of the valve in phase 97*a*, in particular near the point of time of closing 98, is as small as possible. It is further advantageous if the hitting surface 54*a* of the roller surface 54, on which the roller 40 hits at the time 94 of opening of the valve, is designed such that even under certain manufacturing tolerances, a smooth hitting of the roller onto the roller surface 54*a* is guaranteed.

According to the invention, in the valvetrain shown in FIG. 1 the position of the valve crank 14 can be adjusted. The detailed mechanism for this is shown in the valvetrain of FIG. 3. Therein, in addition to the elements shown in FIG. 1, a pivoting frame 80 is visible. The pivoting frame 80 consists of three parts that are fixedly connected with one another, however a different number is equally possible. It is mounted on the cylinder head 3 pivotally about the pivoting axis, wherein the pivoting axis is identical to the driving axis 24 shown in FIG. 1. Further, the valve crank 16 is mounted in the pivoting frame 80, so that the pivoting of the pivoting frame 80 causes a pivoting of the valve crank axis 14, i.e. a change of the position of the valve crank axis 14 along a circular path about the pivoting axis 24.

By the pivoting axis 24 and the driving axis being identical, it is guaranteed that the position of the valve crank axis 14 remains, in every pivoting position of the pivoting frame 80, on a circular segment about the driving axis 24. Thereby it is made sure that the valve crank gearwheel mounted rotatably about the valve crank axis 14 and the driving gearwheel 22 remain in meshing connection regardless of the pivoting position of the pivoting frame 80.

By means of the pivoting drive 84 the pivoting frame can be held in a fixed position or pivoted. In FIG. 3, the pivoting drive 84 is shown symbolically as a rod, which is connected to the pivoting frame 80. The pivoting drive 84 should guarantee a sufficient stability so that the pivoting frame 80 can be securely held in a fixed pivoting position, and such that an unwanted pivoting of the pivoting frame 80 can be inhibited.

In particular, the pivoting drive 84 should guarantee that the bearing of the valve crank 16 can be stably held in a fixed position relative to the cylinder head, in spite of the forces acting thereon. Also, the pivoting frame 80 is preferably constructed such that it has a high degree of stiffness. These measures promote a good transmission of force between the valve crank 16 and the valve 70, a low tolerance of the valvetrain, as well as a high wear resistance of the valvetrain.

The pivoting drive 84 can also be realized in other ways than the rod shown in FIGS. 3 and 5. An alternative pivoting drive could, for example, comprise a hydraulic automatic drive fixedly connected with a pivoting frame, or a gearwheel drive, which meshes in a gear segment fixedly mounted on the pivoting frame 80. The gearwheel segment cant hereby, be mounted on an outer side or an inner side of the pivoting frame.

By the change in position of the axis 14, the guided path 68 of the roller 40 is changed. Herein, as it is shown by means of example in the valvetrain of FIG. 4, the guided path 68 is principally restricted by the guiding element 60 to a circular segment about the guiding axis 66. However, by changing the position of the axis 14, the guided path of the roller 40 can be changed in the sense that a) the portion of the circular segment that the roller 40 covers during its motion is changed, e.g. by a change in the upper and lower turning point of the guided path 68 shown in FIG. 4, and b) by changing the position on this circular segment, at which the roller 40 is provided during a given point in time of the motor cycle.

The motor cycle of a four stroke engine corresponds hereby to a revolution by 720 degrees of the motor crankshaft, and the given point in time of the motor cycle corresponds to a associated phase angle, which runs through the interval of 0 degrees to 360 degrees during the motor cycle, wherein a fixed value of the phase angle is associated to a respective fixed point of the motor cycle, for example the upper dead centre or the lower dead centre of the piston. Such a phase angle can for example be given in a four stroke engine by a rotational angle of the crankshaft of the motor divided by two. Because the driving gearwheel 22 is driven in sync to the motor cycle, a given point in time or a given phase angle of the motor cycle can in particular also be represented by a corresponding rotational angle of the driving gearwheel 22, for example by an angle of a mark provided on the driving gearwheel 22 in relation to the horizontal. By a change of the guided path 68, various properties of the valve lift behaviour 90 shown in FIG. 2 can be influenced. The individual changes are shown in the following. Independent of the described embodiment, the valvetrain according to the invention allows one or more of these changes by a change of the position of the valve crank axis or rotational axis 14.

Firstly, a point of maximum valve lift can be changed. This point is the outermost point of the roller 40 on its guided path in direction of valve opening, which the roller can achieve by turning of the valve crank 16 about the valve crank axis 14; this point corresponds in the valve lifting diagram of FIG. 2 to the point in time 96 of the maximum valve lift. Hence, a lifting height 90*a* (see FIG. 4) of the valve can be changed. The change of the point of maximum valve lift is a accompanied by a change of the portion of the roller surface 54, along which the roller 40 is rolling.

Secondly, the duration (in terms of a motor cycle, i.e. the magnitude of a corresponding phase angle interval) of the opening of the valve can be changed. Preferably, this change goes hand in hand with a change of the duration during which the roller 40 is in contact with the roller surface 54.

Thirdly, a rotational angle of the valve crank 16 relatively to the motor cycle can be changed. Thereby, a phase of the valve opening is changed relatively to the motor cycle, i.e. the valve lifting curve of FIG. 2 is shifted along the x-axis, and/or a given point in time of the valve lifting curve is changed in relation to the motor cycle. Such a given point in time of the valve lifting curve can, for example, be defined by the point in time 96 of the maximum valve lifting or by a point in time that is associated with a particular rotational angle of the valve crank 16.

In the valvetrain shown in FIG. 1, the phase of valve opening is changed in the following manner: as described above, the position of the valve crank axis 14 is changed along the circular segment about the driving axis 24. The angle, about which the valve crank axis 14 is moved along the circular segment, is designated as $\alpha$.

Because during the movement of the valve crank axis 14 the driving gearwheel 22 and the valve crank gearwheel 12 are continuously in meshing connection with each other, and because the meshing connection has a transmission ratio of 1:1, during this motion a rotational angle of the valve crank gearwheel 12 (for example the angle between a mark on the valve crank gearwheel 12 and the horizontal) relative to a rotational angle of the driving gearwheel 22 {for example an angle between a mark on the driving gearwheel 22 and the horizontal) is changed by the value $\alpha$. Thus, also a rotational phase of the valve crank 16, i.e. a rotational angle of the valve crank 16, is changed in relation to the motor cycle by the value $\alpha$. Hence, also a phase of the valve opening relative to the motor cycle is changed by the value $\alpha$.

The valve lift diagram of FIG. 2 shows, as dashed line, a possible change of the valve control caused by a change in position of the valve crank axis 14 away from the rocker lever 50. Herein, it can be seen how the lifting height 90*a*' and a point in time of opening of the valve 96' are changed simultaneously, whereby the point in time of opening of the valve 96' is changed with respect to the point in time 96 by the value $\alpha$. Further, a point in time of opening 94' and of closing 98' and, hence, a duration of opening of the valve are changed.

The solid line of FIG. 2, in which the lifting height 90*a* corresponds to the maximum lifting height 92, could for example correspond to a valve control of an intake valve under full load, and the dashed line could correspond to the valve control of an intake valve under partial load. Under full load, the lifting height 90*a*, the duration 35 and the point in time 96 of the valve opening are chosen such that the valve is opened widely and during a long time, such that a high amount of air-fuel mixture is introduced to the combustion chamber; herein, a high overlapping of an open intake and outtake valve are excepted or desired. At partial load, the lifting height 90*a*' and the duration 35' and point of time 96' of the valve opening are chosen such that a little amount of air-fuel mixture is introduced to the combustion chamber, here, the overlap is reduced or avoided. Thereby, fuel consumption, noise generation, power and further characteristics of the motor can be adapted dynamically to the respective needs.

Further, the change of phase 90*c* or of the control times of the valve lift behaviour are coupled to the change of lifting height and the valve opening duration in such a way that these quantities are adapted to the above mentioned needs under full or partial load. For example, at high rotational speed or load, a high power per motor capacity can be achieved. Simultaneously, the driveability can be improved at low rotational speed and partial load: for example, bucking of the motor can be reduced and/or the response behaviour of the motor can be improved.

Hence, a more effective combustion is possible by an efficiently adapted use of the motor power. This can also lead to a reduction of pollution and fuel consumption. Further, the torque speed characteristic of the motor, the exhaust characteristics and the noise emission can be optimized over the entire range of rotational speed.

The change of valve control can be performed electronically, i.e. by an electronically controlled mechanism for changing the valve crank axis 14, the mechanism being coupled to the pivoting drive 84. The electronic control can be effected in response to various relevant data, for example to a displacement of the throttle control or accelerator or to a position of the throttle control or accelerator, to a rotational speed of the motor, or to a driving speed. Further, the electronic control can be influenced by a traction control system, a system for acoustic control, or a system for controlling emissions. Further, by the electronic control of the valvetrain, a traction control can be easily implemented without accessing the break system.

Thus, in the shown valvetrain, there is no need for a throttle valve, since the fuel intake into the combustion chambers is controlled by the valvetrain. Since losses at the throttle valve can thus be avoided, a better motor performance can be achieved in particular in the high load regime.

Further, the valve control can be adapted with respect to the motor performance in the upper performance regime as well as in respect to exhaust, to fuel consumption or to acoustical compatibility of the motor. On the one hand, high peak performances can be achieved; to this purpose, high valve lifts, long valve opening durations and high overlaps between a simultaneous opening of intake and outtake valves are advantageous. On the other hand, disadvantages in the partial load regime and at low rotational speeds can be avoided, by avoiding overly high valve overlaps.

It is a preferred aspect, independently of the shown embodiments, that the valvetrain 2 allows the lifting height of the valve lifting behaviour or the valve lifting curve 90 to be varied. The lifting height can preferably be varied in a range of lifting heights, which comprises the interval from 0 mm to 5 mm, preferably the interval from 0 mm to 7 mm, further preferred the interval from 0 mm to 10 mm, and particularly preferred the interval from 0 mm to 12 mm.

It is a further preferred aspect of the invention, independently of the shown embodiments, that the valvetrain 2 allows a variation of control times or of the phase 90*c* of the valve lifting curve 90 over a interval of phases or angles, which comprises an interval of 10 degrees (i.e. 10/360 of a motor cycle or 20 degrees of crankshaft angle of a crankshaft of a four stroke engine) and preferably an interval of 15 degrees.

The phase 90*c* can be adjusted without a separate phase adjusting element. This allows advantages with respect to manufacturing cost, space requirements, maintenance requirements and weight. To this purpose, it is advantageous to choose the construction of the valvetrain 2 and in particular the size of the driving gearwheel 22 and of the valve crank gearwheel 24 such that the phase, the lifting height and the opening duration of the valve are adapted to respective needs, for example in respect to different load regimes, simultaneously.

FIG. 5 shows the valvetrain of FIG. 3 in an perspective view. Therein, the three-dimensional arrangement of the elements shown in FIG. 3 is visible. In addition to the elements of FIG. 3, herein a sprocket wheel 26 is shown, which is connected to the driving gearwheel 22 for driving the driving gearwheel 22 by means of a chain, which in turn is driven by the crankshaft of the motor. The transmission ratio of this drive is chosen such that the driving gearwheel 22 is rotatable synchronously to the motor cycle of the combustion engine, i.e. in a four stroke engine the transmission ratio between motor crankshaft and driving gearwheel is 2:1.

Further, it can be seen that the valvetrain provides for the simultaneous operation of two valves. To this purpose, a common transmission rod is connected, via a common connecting element 38, with two rollers 40 (wherein only one of the rollers is visible); the rollers 40 are guided by a respective own guiding element 60, 60'. Further, two rocker levers 50, 50' are visible, which actuate a respective valve, wherein only one of the valves is visible.

The guiding elements 60, 60' are connected to the connecting element 38, either by a bearing, for example a rolling bearing, or by a fixed connection. On an outer side of the connecting element 38, the rollers 40 are rotatably mounted; on an inner side, the connecting rod 30 is mounted rotatably on the connecting element 38. This ensures that both valves are actuated synchronously.

The valvetrains shown in FIGS. 1 to 5 can be varied in various aspects. In the following, embodiments are described that result for example as variations of the valvetrains shown in FIGS. 1 to 5. These variations are, however, independent of the embodiments shown therein, insofar as that they could equally be implemented in combination with other embodiments, for example with the embodiments shown in FIGS. 6 to 14 or in still further embodiments.

In an embodiment, the transmission ratio between valve crank gear wheel 12 and driving gear wheel 22 is not 1:1 but is generally l:x. It is a preferred aspect of the invention that the valve crank 16 or a corresponding rotatable driving means is rotated synchronously to the motor cycle, i.e. that one motor cycle corresponds to a full revolution of the valve crank 16. The driving gear wheel 22 should therefore be driven with such a transmission ratio to the motor crankshaft that this condition is fulfilled. In a four stroke engine, the transmission ration between driving gear wheel and motor crankshaft should therefore be x:2.

In a further embodiment the valve crank 16 can also be driven by a different mechanism than that of FIG. 1. For example, the valve crank 16 can also be driven by any other driving means that is common for a crankshaft. Herein, it is preferred that when the position of the valve crank axis 14 is changed, there is also a change of the rotational angle or a phase of the valve crank 16, and hence of the phase of the valve lifting curve.

For example, the valve crank 16 can be driven by a chain, which is a meshing connection with a sprocket wheel connected to the valve crank 16. Herein it should be made sure that the transmission ratio is such that a full revolution of the valve crank corresponds to a motor cycle. By changing the position of the valve crank axis 14, it may be possible changing the position of the sprocket wheel along the circumference of the chain. If 1 designates the distance, by which the sprocket wheel travels along the circumference of the chain, and if L represents the length, by which the chain advances during a motor cycle, then the resulting change of rotational angle of the valve crank 16 is given by the angle $$\alpha=(1/L)\times 360 \text{ degrees}$$

Consequently, the rotational angle or phase of the valve crank 16 and hence the phase of the valve lifting curve relative to the motor cycle changes by the value α.

In a further embodiment, further elements which are common for a valvetrain can be added. For example it is possible to adjust the phase of the driving means 16 independently of the valve lift by means of an optional phase adjustment element.

In a further embodiment, elements of the valvetrain can be replaced by elements of respective equivalent function. For example, the valve crank 16, which is shown to be a crank shaft, can also be realized as an eccentric shaft. Further, for example the valve spring shown as a spiral spring can also be realized as a pneumatic spring.

In a further embodiment, an alternative design of the rocker lever 50 is possible, in which the roller 22 touches the roller surface 55 or the rocker lever 50 also during the valve closing phase 39, and thus provides a fixed stop for the rocker lever 50. In this case, the roller surface 54 is divided into a closing portion, which corresponds to the closing phase 39 of the valve; and into an opening portion, which corresponds to an opening of the valve, i.e. to the phases 95*a*, 95, 97 and 97*a*. In this embodiment, the holding element 57 can be disposed with; and the valve clearance of the valve needs to be adjusted via the valve adjusting element 71.

In a further embodiment the rocker lever 50 can be pushed by a rocker lever spring towards the valve 70. Thereby, preferably a non-positive contact between rocker lever 50 and valve 70 can also be achieved when the roller 40 does not push onto the rocker lever 50. For example, a torsion spring, a spiral spring, a hydraulic, pneumatic or any other spring can be used as rocker lever spring. Further, instead of a spring, any other means that achieves pushing of the rocker lever towards the valve 70 can be used as well. In this case, there is no necessity for the holding element shown in FIG. 1, since its function of providing a contact between valve 70 and rocker lever 50 can be achieved by the rocker lever spring. In this case, also the adjusting element 71 can be disposed with, if a non-positive connection between rocker lever 50 and spring 70 ensures sufficient valve clearance independent of small manufacturing tolerances. In this case a simple adjustment of the valve clearance can be achieved, which is tolerant with respect to changes of the valvetrain or of the valve seat due to wear.

In an further embodiment, the roller 40 can be replaced by an alternative pushing element, for example a sliding block, which pushes onto the pushing receiving surface 54 of the rocker lever 50.

In a further embodiment, the roller or pushing element 40 can be mounted at any place of the pushing rod 30 or the guiding element 60. The kind of mounting can further be in any suitable manner. If the roller 40 is mounted on the connecting rod 30, then—differently from FIG. 4—the guided path 68 of the roller 40 can also comprise a backwards motion that is different from the forward motion of the roller 40. As long as a pivoting motion 60 of the guiding element or a lifting motion of the connecting rod 30 is transmitted to the roller 40 in such way that a rotation of the valve crank 16 moves the roller 40 along a periodic path, the embodiment of FIGS. 1 to 5 can be adapted in a simple manner to the changed mounting of the roller or the pushing element 40. To this purpose, mainly the arrangement of the rocker lever 50 and the contour of the pushing receiving surface 54 need to be adjusted.

In a further embodiment, the pushing element pushes directly onto the valve stem of the valve 70. To this purpose, the connecting rod 30 and the guiding element 40 are preferably designed in such a range that the result is a suitable guided path 68 of the pushing element 40, i.e. a guided path that is approximately in direction of the valve axis of the valve 70. This embodiment does in particular not necessitate a rocker lever.

In a further embodiment, when the position of the valve crank axis 14 is changed, the position of the guiding axis 66 is changed as well. This embodiment can for example be realized by mounting not only the valve crank 16 at its axis 14, but also the guiding element 60 at its guiding axis 66 within the pivotable frame 80. In this embodiment, a pivoting of the pivoting frame 80 does not only change the guided path 68 of the roller 40 along the circular segment about the guiding axis 66; instead, in contrast to the embodiment shown in FIG. 1, also the circular segment itself, i.e. its centre 66, is changed.

FIG. 6 shows a further embodiment of a valvetrain according to the invention in a cross-sectional side view. This valvetrain corresponds in its functional features to the valvetrain of FIG. 1, so that the description of FIG. 1 can substantially also be used for FIG. 6; same or similar components are referred to using identical reference numbers.

In comparison to the valvetrain shown in FIG. 1, individual elements of the valvetrain of FIG. 6 are arranged differently. In particular, the motion of the roller 40 along the roller surface 55 is rather in horizontal direction, whereas in FIG. 1 it is rather in vertical direction.

Further, the guiding element 60 is arranged such that depending on the motional state of the valvetrain, more or less—it is almost collinear with the valve axis {dashed line} of the valve 70, whereas the connection rod 30 is arranged almost perpendicular to the valve axis. By this arrangement, the counterforce for compensating the pushing force generated by the valve spring 72 or the acceleration generated by the lifting movement of the valve 70, can be provided mainly via the guiding element 60, which is fixedly mounted at the guiding axis 66 within the cylinder head.

In contrast to the valvetrain shown in FIG. 1, a spring 58 acts upon the rocker lever, so that a non-positive connection between the rocker lever 50 and the valve 70 is provided even when the roller 40 does not push onto the rocker lever 50. The spring is shown as a torsional spring, however also a spiral spring, a hydraulic spring, a pneumatic or any other spring can be used. In analogy to FIG. 3, the spring can also be replaced by a holding element that provides a fixed stop of the rocker lever 50.

In analogy to FIG. 1*b*, the valvetrain comprises a compensating mass element 18. The compensating mass element 18 is mounted directly on the valve crank gear wheel 12. In order to avoid an unwanted mass moment and hence an unbalanced load of the valve crank 16, a further compensating mass element of equal size is mounted symmetrically to the shown compensating mass element 18 on the valve crank 16.

FIG. 7 shows a cross-sectional front view of the valvetrain of FIG. 6. Therein, the spatial arrangement of the various elements shown in FIG. 6 can be understood in more detail. The valvetrain is designed for driving two valves 70, 70'. The connecting rod 30 is provided for actuating both valves. The connecting rod is mounted rotatably about the connecting element 38 by a rolling bearing. The connecting element 38 is fixedly connected to the guiding element 60. This connection defines the rotatable or pivotable joint connection 36 between the connecting rod 30 and the guiding element 60.

Further, two rollers 40, 40' are rotatably mounted on the connecting element 38 by a rolling bearing 42. Beneath each of the rollers 40, 40', a respective rocker lever 50, 50' is mounted for being actuated by the rollers. Each of the rocker lever 50, 50' in turn actuates an own valve 70, 70'.

Independent of the shown embodiment, it is advantageous that the connecting rod is mounted (as is shown here) rotatably about a connecting element 38, wherein the connecting element 38 is preferably fixedly connected to the guiding element 60. Likewise, it is preferred that the roller 40 is mounted rotatably about the connecting element 38.

The guiding element 60 comprises at its upper end a frame, which encompasses the connecting rod 30 as well as the rollers 40, 40', and whose outer surface is fixedly connected to the outer surface of the connecting element 38. Hereby, the connecting element 38 is supported on both sides of the rollers 40, 40'. Hence, the frame allows an improved force transmission via the connecting element 38, without there being an overly large imbalanced load on the connecting element 38.

The valvetrain of FIG. 7 is described for the actuation of two valves 70, 70'. Nevertheless, the valvetrain can be adapted for any other number of valves by means of simple modifications.

FIG. 8 shows a cross-sectional side view of a valvetrain according to the invention. In addition to the elements shown in FIGS. 6 to 7, also a pivoting frame 80 is shown, which is pivotable about the pivoting axis 24, wherein the pivoting axis 24 and the rotational axis of the driving gearwheel are again identical. Structure and function of the pivoting frame 80 are essentially analogous to the description of FIG. 3, wherein some differences with respect to the pivoting frame are described in the following. The pivoting frame of FIG. 8 consists of two fixedly connected parts, which are connected to each other by means of a screw connection with screws 86.

On the right side of the pivoting frame 80, the pivoting drive 84 is shown. It comprises a teeth segment 84*a* which is in fixed connection with the pivoting frame 80, and which is in meshing connection with a gearwheel 84*b*. The pivoting frame 80 can be pivoted by moving the teeth segment 84*a* up and down by turning the gearwheel 84*b*. In correspondence to this function, the teeth segment 84*a* is bent along a circular segment about the pivoting axis 24.

Independent of the embodiment described herein, it is generally advantageous that the gearwheel 84*b* is arranged such that it is rotatable about the rocker lever axis 52. This allows for a compact construction that has advantages with respect to spatial requirements and also with respect to the rigidity of the construction.

FIG. 9 shows the valvetrain of FIG. 8 in a perspective view. In addition, a further pair of valves 78 is shown in FIG. 9, which are realized as tappet valves. The valves 78 are driven by a conventional camshaft drive 5. The camshaft drive 5 is driven together with the drive of the valve crank 16 by the driving gearwheel 22. The conventionally driven valves 78 of FIG. 9 are exhaust valves, whereas the valves 70 driven according to the invention are intake valves.

Further, a worm gear 84*c* is shown in FIG. 9. The worm gear 84*c* is in meshing connection with a gearwheel 84*b* and serves for rotating the latter. Thereby, the pivoting frame 80 can be pivoted as described for FIG. 8. The worm gear 84*c* is driven by a electronically controlled motor (not shown) in analogy to the description of the pivoting frame of FIG. 1.

As an alternative to the worm gear 84*c*, the gearwheel 84*b* could also be driven for example by a gear, a sprocket drive, a pair of bevel gearwheels, or in any other manner. Here, a drive is preferred that avoids an unwanted pivoting of the pivoting frame 80.

FIG. 10*a* shows a side view of a valvetrain. The elements shown in FIG. 10*a* correspond to the respective descriptions of FIGS. 6 to 9. FIG. 10*b* shows an enlarged view of a part of FIG. 10*a*. Therein, the rolling surface 54 can be seen more clearly than in FIG. 10*a*. The roller 40 is in this figure located on the hitting portion of the roller surface, i.e. on the portion at which the roller hits the roller surface and hence gets into contact with the roller surface during its motion along its guided path. It can be seen in FIG. 10*b* that the hitting portion of the roller surface 54 is formed such that it is hit by the roller 40 smoothly, i.e. in a angle that is as flat as possible, thereon (for illustrating this fact, in FIG. 10*b* the guided path of the hitting portion of the roller 40 is shown as dashed line 40*a*). It can also be seen that there is a ramp portion around the hitting portion, which is slightly sloped with respect to this guided path. The ramping portion allows to provide a suitable hitting portion in spite of possible manufacturing tolerances. Also in other embodiments it is advantageous to provide a ramping portion of the roller surface or of the pushing receiving surface 54, which comprises a hitting portion of the roller or of the pushing element 40, and that preferably is at an angle to the guided path of the pushing element that preferably is less than 30 degrees and particularly preferably less than 20 degrees.

Further, the roller surface 54 is formed in FIG. 10*b* such that the valve is opened slowly in the beginning (i.e. at small opening), and that is subsequently opened fast up to the full lift height (corresponding to the phases 95*a* and 95*b* shown in FIG. 2) and/or that has an opposite behaviour at valve closing (corresponding to the phases 97*b* and 97*a* shown in FIG. 2).

FIG. 11 is a further side view of the valvetrain of FIG. 9. In contrast to FIG. 10*a*, also the further valves 78 of FIG. 9 and their drive are shown therein.

In the valvetrains shown in FIGS. 6 to 11, the pivoting frame is adjusted to respective small lifting heights, i.e. it corresponds to the valve lifting diagram shown in FIG. 2 as dashed line. FIG. 12 shows a further perspective view of the valvetrain shown in FIGS. 6 to 11, in which the pivoting frame 80 is, however, adjusted for large valve lift. A side view of this configuration is further shown in FIG. 13.

Starting from the state shown in FIGS. 6 to 11, in the valvetrain of FIGS. 12 and 13 the pivoting frame 80 is pivoted in direction of the valve 70. As described above, the pivoting of the pivoting frame 80 is achieved as follows: If the worm gear 84*c* is rotated, then the gearwheel 84*b* rotates. The gearwheel 84*b* acts on the teeth segment 84*a*, such that the teeth segment 84*a* is moved in direction of the valve 70, whereby the pivoting frame 80 is pivoted.

By the pivoting frame 80 being pivoted by an angle $\alpha$ towards the valve 70 when compared to the state shown in FIGS. 6 to 11, the position of the valve axis 14 is changed, i.e. rotated by an angle $\alpha$ about the pivoting axis 24. A first consequence of this change is that the roller 40 rolls back and forth along a changed portion of the roller surface 54. The changed portion of the roller surface has the following consequences:

Firstly, the roller 40 reaches a portion of the roller surface 54 that corresponds to a larger valve lift when compared to the portion reached in FIGS. 6 to 12. Hence, the lifting height 90*a*, i.e. the maximum valve lift that can be reached in a cycle, is increased. Thereby, in particular the integrated valve lift, i.e. the area beneath the valve lift diagram of FIG. 2, increases as well.

Secondly, the roller 40 touches and pushes the roller surface 54 across a increased rotational portion of the valve crank 16. Consequently, the point in time of valve opening 94 shown in FIG. 2 takes place at a smaller rotational angle of the valve crank 16, i.e. at an rotational angle that is reached earlier. Correspondingly, the point in time of valve closing 98 takes place at a rotational angle of the valve crank 16 that is reached later. The valve opening duration between these points in time is consequently longer, and the valve closing phase 93 is correspondingly shorter. Herein, as in other parts of the description, the duration is in terms of a motor cycle.

A second consequence of the change in position of the valvetrain axis 14 is that the rotational angle of the valve crank 16 is changed by the angle $\alpha$ when compared to a rotational angle of the driving gearwheel 22. Hereby, the phase of the valve crank rotation, i.e. the phase angle relative to the motor cycle, is changed by a phase angle $\alpha$. Consequently, the phase of the valve lift diagram is changed by a phase angle a (90*c*), i.e. for example the point in time of maximum valve lift 96 is shifted by a phase angle $\alpha$ (90*c*).

Figure 14:
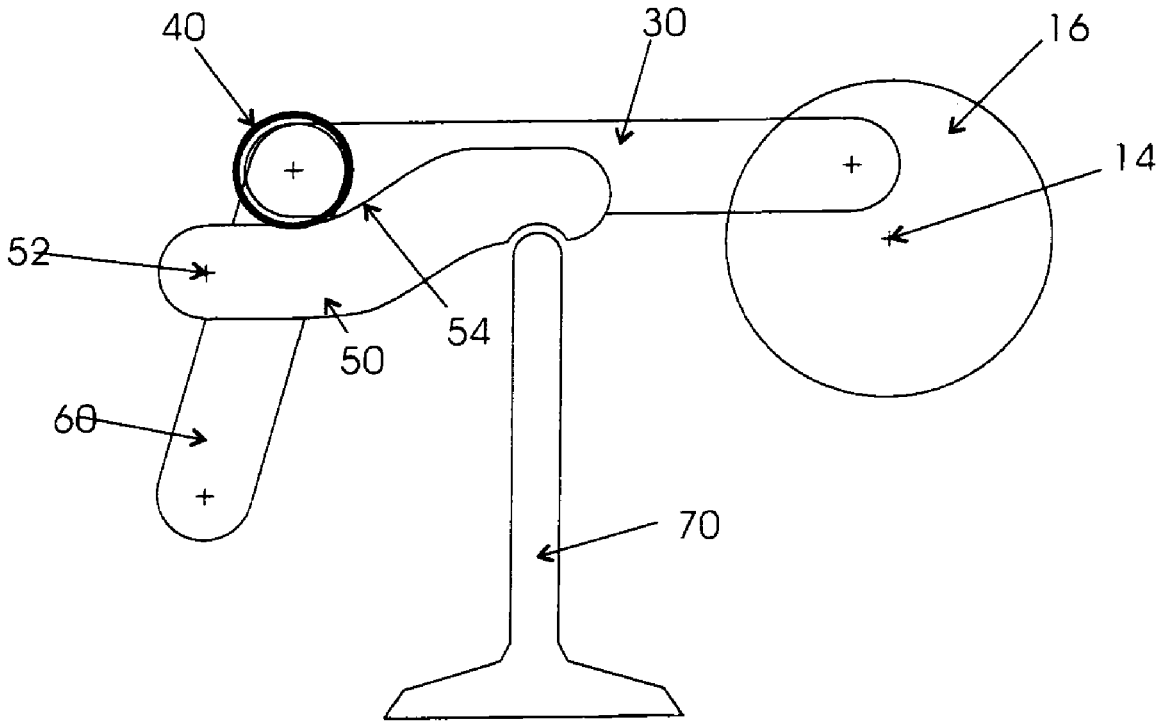
FIG. 14 shows a side view of a further embodiment of a valvetrain according to the invention.

A further valvetrain according to the invention is schematically shown in FIG. 14. This valvetrain corresponds essentially to the embodiment shown in FIG. 1 the same or similar components are referred to with identical numbers.

A difference to FIG. 1 is that the rocker lever 50 is pushed in direction of the valve 70, by movement of the roller 40 away from the rocker lever axis 52. Hence, the lever of the rocker lever 50 can be used efficiently when the rocker lever is pushed in direction of the valve 70.

In the valvetrain shown in FIG. 14, and in contrast to the embodiments of FIGS. 1 to 13, the rocker lever 50 is so long that the roller 40 is always in contact with the rocker lever. Consequently, there is no need anymore to provide for a separate stop 57 or a lever holding spring 58.

The drive of the valve crank 16 is not shown and can be implemented analogously to FIG. 1.

The position of the valve crank axis 14 can be changed, i.e. adjusted. The mechanism for that is not shown explicitly and can be implemented by means of a pivoting frame, which is analogous to the pivoting frame 80 shown in FIG. 3.

The invention claimed is:

1. A combustion engine having a valvetrain for actuating a first intake valve and a second intake valve, comprising:

a first driving member, which is arranged in a cylinder head portion of the combustion engine, and which is rotatable about a first rotation axis for actuating the first and second intake valves;

a second driving member for driving the first driving member, wherein the second driving member is rotatable about a second rotation axis;

a connecting rod with a first joint and a second joint; and a guiding member for guiding the connecting rod, the guiding member being pivotable around a guiding member axis; and a valve spring, wherein:

the first joint of the connecting rod is joined to the first driving member; and the second joint of the connecting rod is joined to the guiding member;

the position of the first rotation axis is pivotable about the second rotation axis; and a phase relation between a rotational angle of the first driving member and an engine cycle is adjustable by the pivoting of the position of the first rotation axis.

2. The combustion engine according to claim 1, further comprising:

a pushing member fastened to the guiding member.

3. The combustion engine according to claim 2, wherein the pushing member is a roller.

4. The combustion engine according to claim 1, wherein a quantity characterizing a valve lifting behavior is adjustable by the adjustment of the position of the first rotation axis.

5. The combustion engine according to claim 4, wherein the quantity characterizing the valve lifting behavior is a magnitude of valve lift, a duration of the valve opening, or both.

6. The combustion engine according to claim 1, wherein adjusting of the position of the first rotation axis is a pivoting of the first rotation axis around a pivoting axis.

7. The combustion engine according to claim 6, further comprising:

a pivoting drive for pivoting the first rotation axis, the pivoting drive comprising:

a pivoting drive gearwheel, which is rotatable about a third rotation axis, and a pivoting drive gear segment, which is in meshing connection with the pivoting drive gearwheel.

8. The combustion engine according to claim 7, wherein the transmission member is a lever, which is pivotable around a lever axis, and wherein the third rotation axis is also the lever axis of the lever.

9. The combustion engine according to claim 7, further comprising:

a worm gear for driving the pivoting drive gearwheel, the worm gear being in meshing connection with the pivoting drive gearwheel.

10. The combustion engine according to claim 1, wherein the connecting rod and the guiding member are members of a pinned, planar linkage.

11. A combustion engine according to claim 1, having a valvetrain for actuating a valve, comprising:

a first driving member, which is arranged in a cylinder head portion, and which is rotatable about a first rotation axis;

a connecting rod with a first joint and a second joint;

a guiding member for guiding the connecting rod, the guiding member being pivotable around a guiding member axis; and a valve spring, wherein the first joint of the connecting rod is joined to the first driving member and the second joint of the connecting rod is joined to the guiding member; and wherein the position of the first rotation axis is adjustable, wherein a maximum valve lift of the valve is at least 5 mm.

12. A combustion engine having a valvetrain for actuating a valve, comprising:

a first driving member, which is arranged in a cylinder head portion, and which is rotatable about a first rotation axis;

a second driving member for driving the first driving member, wherein the second driving member is rotatable about a second rotation axis and is a second driving gearwheel a connecting rod with a first joint and a second joint;

a guiding member for guiding the connecting rod, the guiding member being pivotable around a guiding member axis;

a valve spring, wherein the first joint of the connecting rod is joined to the first driving member and the second joint of the connecting rod is joined to the guiding member, wherein the position of the first rotation axis is adjustable; and a first driving gearwheel for driving the first driving member, wherein the first driving gearwheel is rotatable about the first rotation axis.

13. A combustion engine having a valvetrain for actuating a valve, comprising:

a first driving member, which is arranged in a cylinder head portion, and which is rotatable about a first rotation axis;

a connecting rod with a first joint and a second joint;

a guiding member for guiding the connecting rod, the guiding member being pivotable around a guiding member axis;

a valve spring, wherein the first joint of the connecting rod is joined to the first driving member and the second joint of the connection rod is joined to the guiding member; and wherein the position of the first rotation axis is adjustable;

a pushing member fastened to the guiding member; and a transmission member in releasable mechanical contact with the pushing member.

14. The combustion engine according to claim 13, wherein the transmission member is biased, by a forcing member, towards the valve.

15. The combustion engine according to claim 13, further comprising:

a fixed stop defining a maximum displacement of the transmission member.

16. The combustion engine according to claim 13, wherein the transmission member is a lever, which is pivotable around a lever axis.

17. The combustion engine according to claim 16, wherein the lever is a one-arm lever.

18. The combustion engine according to claim 16, wherein a movement of the pushing member toward the lever axis causes the valve to open.

19. A combustion engine having a valvetrain for actuating a valve, comprising:

a first driving member, which is arranged in a cylinder head portion, and which is rotatable about a first rotation axis;

a connecting rod with a first joint and a second joint;

a guiding member for guiding the connecting rod, the guiding member being pivotable around a guiding member axis;

a valve spring, wherein the first joint of the connecting rod is joined to the first driving member and the second joint of the connecting rod is joined to the guiding member; and wherein the position of the first rotation axis is adjustable; and a pushing member fastened to the guiding member, wherein the pushing member is guided to follow a guided path, and the guided path of the pushing member is adjustable by the adjustment of the position of the first rotation axis.

20. A combustion engine having a valvetrain for actuating a valve, comprising:

a first driving member, which is arranged in a cylinder head portion, and which is rotatable about a first rotation axis;

a connecting rod with a first joint and a second joint;

a guiding member for guiding the connecting rod, the guiding member being pivotable around a guiding member axis;

a valve spring, wherein the first joint of the connecting rod is joined to the first driving member and the second joint of the connecting rod is joined to the guiding member, wherein the position of the first rotation axis is adjustable;

a first driving gearwheel for driving the first driving member, wherein the first driving gearwheel is rotatable about the first rotation axis; and a second driving member for driving the first driving member, wherein the second driving member is rotatable about a second rotation axis wherein, the valve is an intake valve, and the second driving member also actuates an exhaust valve.

21. A valvetrain for actuating a first intake valve and a second intake valve of a combustion engine, comprising:

a first driving member, which is rotatable about a first rotation axis for actuating the first and second intake valves;

a second driving member for driving the first driving member, wherein the second driving member is rotatable about a second rotation axis;

a connecting rod with a first joint and a second joint; and a guiding member for guiding the connecting rod, the guiding member being pivotable around a guiding member axis; and a valve spring, wherein:

the first joint of the connecting rod is connected to the first driving member, and the second joint of the connecting rod is connected to the guiding member, the position of the first rotation axis is pivotable about the second potation axis;

the valvetrain is designed to be arranged in a cylinder head portion of the combustion engine; and a phase relation between a rotational angle of the first driving member and an engine cycle is adjustable by the pivoting of the position of the first rotation axis about the second rotation axis.

22. A combustion engine having a valvetrain for actuating a first intake valve and a second intake valve, comprising:

a first driving member, which is arranged in the cylinder head portion, and which is rotatable about a first rotation axis for actuating the first and second intake valves;

a second driving member for driving the first driving member, wherein the second driving member is rotatable about a second rotation axis;

a connecting rod with a first joint and a second joint; and a guiding member for guiding the connecting rod, the guiding member being pivotable around a guiding member axis; and a valve spring, wherein the connecting rod and the guiding member are members of a pinned linkage, and wherein the position of the first rotation axis is pivotable about the second rotation axis, wherein a phase relation between a rotational angle of the first driving member and an engine cycle is adjustable by the pivoting of the position of the first rotation axis about the second rotation axis.

* * * * *

UNITED STATES PATENT AND TRADEMARK OFFICE

CERTIFICATE OF CORRECTION

PATENT NO. : 8,042,505 B2
APPLICATION NO. : 11/911719
DATED : October 25, 2011
INVENTOR(S) : Eisenbeis It is certified that error appears in the above-identified patent and that said Letters Patent is hereby corrected as shown below:

In the Drawings:

Sheet 1 of 17, please delete "Figur 1" and insert -- Fig. 1 -- therefor;

Sheet 4 of 17, please delete "Figur 3" and insert -- Fig. 3 -- therefor;

Sheet 4 of 17, please delete "Figur 4" and insert -- Fig. 4 -- therefor;

Sheet 5 of 17, please delete "Figur 4" and insert -- Fig. 4 -- therefor;

Sheet 5 of 17, please delete " 54a " and insert -- 54a -- therefor;

Sheet 6 of 17, please delete "Figur 5" and insert -- Fig. 5 -- therefor;

Sheet 7 of 17, please delete "Figur 6" and insert -- Fig. 6 -- therefor;

Sheet 8 of 17, please delete "Figur 7" and insert -- Fig. 7 -- therefor;

Sheet 9 of 17, please delete "Figur 8" and insert -- Fig. 8 -- therefor;

Sheet 10 of 17, please delete "Figur 9" and insert -- Fig. 9 -- therefor;

Sheet 11 of 17, please delete "Figur 10a" and insert -- Fig. 10a -- therefor;

Sheet 11 of 17, please delete "Figur 10b" and insert -- Fig. 10b -- therefor;

Sheet 12 of 17, please delete "Figur 10b" and insert -- Fig. 10b -- therefor;

Sheet 13 of 17, please delete "Figur 11" and insert -- Fig. 11 -- therefor;

Sheet 14 of 17, please delete "Figur 12" and insert -- Fig. 12 -- therefor;

Sheet 15 of 17, please delete "Figur 13a" and insert -- Fig. 13a -- therefor;

Sheet 15 of 17, please delete "Figur 13b" and insert -- Fig. 13b -- therefor;

Sheet 16 of 17, please delete "Figur 13b" and insert -- Fig. 13b -- therefor;

In Detailed Description of the Invention:

Column 9, Line 38, please delete "stern" and insert -- stem -- therefor.

Signed and Sealed this
Thirtieth Day of April, 2013

Teresa Stanek Rea
*Acting Director of the United States Patent and Trademark Office*